US005729788A

United States Patent [19]

Hirohashi et al.

[11] Patent Number: 5,729,788

[45] Date of Patent: Mar. 17, 1998

[54] IMAGE FORMING APPARATUS HAVING CONTROL STRUCTURE FOR CLEANING THE TRANSFER DEVICE

[75] Inventors: Norichika Hirohashi; Tsukasa Inao; Kazuhisa Masuko; Toshihiro Kanematsu, all of Ebina, Japan

[73] Assignee: Fuji Xerox Co., Ltd., Tokyo, Japan

[21] Appl. No.: 614,717

[22] Filed: Mar. 13, 1996

[30] Foreign Application Priority Data

Mar. 16, 1995 [JP] Japan ..... 7-056948
Jan. 17, 1996 [JP] Japan ..... 8-006134

[51] Int. Cl.[6] ..... G03G 15/16; G03G 21/00

[52] U.S. Cl. ..... 399/66; 399/71; 399/101; 399/302; 399/388

[58] Field of Search ..... 355/271, 273, 355/274, 277, 208, 309, 316, 302, 317; 399/66, 101, 388, 389, 71

[56] References Cited

U.S. PATENT DOCUMENTS

| | | | |
|---|---|---|---|
| 3,923,391 | 12/1975 | Washio et al. | 355/271 |
| 5,101,238 | 3/1992 | Creveling et al. | 355/271 |
| 5,233,394 | 8/1993 | Fujita et al. | 355/271 |
| 5,253,022 | 10/1993 | Takeuchi et al. | 355/274 |
| 5,318,631 | 6/1994 | Tsukamoto | 399/318 X |
| 5,504,565 | 4/1996 | Tomiki et al. | 355/274 |
| 5,530,535 | 6/1996 | Matsuoka | 399/66 X |
| 5,534,984 | 7/1996 | Inoue | 355/271 |

FOREIGN PATENT DOCUMENTS

| | | | |
|---|---|---|---|
| A-56-126876 | 10/1981 | Japan . | |
| 4-361284 | 12/1992 | Japan . | |
| 5-181372 | 7/1993 | Japan | 355/274 |
| A-5-333714 | 12/1993 | Japan . | |
| A-6-95521 | 4/1994 | Japan . | |

*Primary Examiner*—Arthur T. Grimley
*Assistant Examiner*—Sophia S. Chen
*Attorney, Agent, or Firm*—Oliff & Berridge, P.L.C.

[57] ABSTRACT

A transfer sheet detect sensor for detecting the presence or absence of a transfer sheet is disposed between a point of contact where a developing device for developing an electrostatic latent image formed on an image carrier to form a toner image is contacted with a transfer roller in a transfer portion and a point of tucking provided just upstream of the contact point where the transfer sheet is tucked into the image carrier just upstream of the contact point, the transfer roller is disposed such that it can be contacted with and retreated (separated) from the image carrier, and a cleaning roller is provided such that it can be contacted with the transfer roller while the transfer roller is retreated to its separated position, whereby a given cleaning voltage is applied to the transfer roller when the transfer roller is cleaned by the cleaning roller.

9 Claims, 14 Drawing Sheets

IMAGE FORMING APPARATUS HAVING CONTROL STRUCTURE FOR CLEANING THE TRANSFER DEVICE

BACKGROUND OF THE INVENTION

The present invention relates to an image forming apparatus using an electrophotographic system, such as a copying machine, a printer or the like and, in particular, to an image forming apparatus including means for electrostatically transferring a toner image formed in an image carrier to a transfer sheet or means for primarily transferring a toner image formed in an image carrier to an intermediate transfer medium and thereafter secondarily transferring the primarily transferred toner image to a transfer sheet.

In an image forming apparatus using an electrophotographic system such as a copying machine, a printer or the like, electric charges are uniformly formed on an image carrier such as a photoreceptor drum comprising of a photoconductive photoreceptor, an electrostatic latent image is formed by use of a laser beam modulated by an image signal, and, after then, the electrostatic latent image is developed with a charged toner to thereby provide a visualized toner image.

And, the toner image is electrostatically transferred directly or through an intermediate transfer medium to a transfer member such as a recording sheet or the like and, after then, the transferred toner image is fixed by heating and pressurizing the same to thereby obtain a required reproduced image.

Also, to form a multi-color image, toner images of respective colors are superimposed on top of another on the image carrier or on the intermediate transfer medium and, after then, they are transferred to the transfer sheet.

Now, FIG. 12 is a schematic typical view of the main portions of an embodiment of an image forming apparatus to which the invention is applied. In FIG. 12, 1 designates a photoreceptor drum serving as an image carrier, 2 a developing device, 3 a transfer roller serving as transfer means, 8 a transfer sheet, 9 a registration roller, 16 a sheet feed mechanism, 20 a cleaning device, 21 a charging device, 22 a peel-off charger, 23 a laser, 24 a polygonal mirror, 25 and 26 scanning lens systems, 30 a -tray, 31 a sheet discharge mechanism, and 32 a fixing device.

In FIG. 12, the photoreceptor drum 1 serving as an image carrier is uniformly charged by the charging device 21. The photoreceptor drum 1 is scanned through the scanning lens systems 25 and 26 by a beam from a laser modulated by an image signal to thereby form an electrostatic latent image on the photoreceptor drum 1.

The electrostatic latent image formed on the photoreceptor drum 1 is then developed by the developing device 2 with a toner into a visible toner image, and the visible toner image is transferred electrostatically to the transfer sheet 8 by the transfer roller 3 which is disposed in a transfer portion.

The transfer sheet 8 is taken out one by one from the sheet tray 30 and is fed through the sheet feeding mechanism 16 to the registration roller 9. After then, the transfer sheet 8 is further fed between the photoreceptor drum 1 and transfer roller 3 at a given timing in response to the rotational movement of the photoreceptor drum 1.

The transfer roller 3, to which is applied a potential having the opposite polarity to the polarity of the toner carried by the photoreceptor drum 1, attracts the toner electrostatically and transfers it to the transfer sheet 8. The transfer sheet 8 with the toner image transferred thereto is peeled off from the photoreceptor drum 1 in an electric field applied by the peel-off charger 22 and is moved through the sheet discharge mechanism 31 to the fixing device 32, where it is processed, that is, it is heated and pressurized to thereby fix the toner image.

After the toner image is transferred to the transfer sheet from the photoreceptor drum 1, the photoreceptor drum 1 is cleaned in the cleaning device in such a manner that the residual toner is removed therefrom, and the drum 1 is then charged uniformly by the charging device 21 for the next transfer cycle.

On the other hand, the transfer roller 3, which consists of a conductive rotary roller, holds the transfer sheet 8 between the photoreceptor drum 1 and itself and applies a given transfer voltage to the transfer sheet 8 to thereby transfer the toner image carried by the photoreceptor drum 1 to the transfer sheet 8.

When compared with a transfer device of a corotron system which is disposed in non-contact with the transfer sheet, the transfer device using the above-mentioned type of roller is able to transfer the toner image with a lower voltage and is also able to hold the transfer sheet positively in the transfer portion to thereby provide a good transferred image with no out-of-position transfer. Further, the present transfer device is advantageous in that it produces little ozone, when compared with the transfer device of a corotron system.

However, in the present transfer device using the transfer roller, since the transfer roller 3 is always in contact with the photoreceptor drum 1, if the image forming apparatus is caused to stop for an unusual reason during the image forming operation, then the transfer roller 3 is contaminated by the toner left on the photoreceptor drum 1 or toner patterns formed on the photoreceptor drum 1 for toner density control. Adhesion of such contaminant to the surface of the transfer sheet 8 not only contaminates the surface of the transfer sheet 8 but also lowers the transfer performance of the transfer roller 3.

Conventionally, to solve the above-mentioned problems, for example, as disclosed in Japanese Patent Publication No. Hei 5-333714, there is known a transfer device in which a transfer roller is separated from a photoreceptor drum in other time than the time when a transfer operation is carried out.

However, in this conventional transfer device as well, when a transfer sheet is caused to jam up during the image forming operation, the transfer roller is contacted with the photoreceptor drum with no sheet held between them, so that a large quantity of toners are inevitably stuck to the transfer roller. If a large quantity of toners are stuck to the transfer roller, then it is difficult to remove them from the transfer roller.

Also, in a conventional technique disclosed in Japanese Patent Publication No. Sho 56-126876, there is provided a sensor which is used to detect a transfer sheet to be fed to a transfer portion, and a transfer roller can be contacted with a photoreceptor drum in accordance with the detected output of the sensor. However, because whether the transfer roller can be separated from the photoreceptor drum or not depends on the mounting position of the transfer roller, similarly to the above-mentioned conventional transfer device, toners are stuck to the transfer roller.

Now, FIG. 13 is a typical view of an arrangement in which a transfer sheet sensor is disposed just in the rear of a registration roller, explaining the contamination of a transfer roller caused when transfer sheets jam up.

In FIG. 13, since a transfer sheet detect sensor 5' is disposed just behind a registration roller 9, when a transfer sheet 8 is caused to jam after the sensor 5' passes through the registration roller 9, a transfer roller 3 is Contacted with a photoreceptor drum 1 with a transfer sheet held between them, with the result that the toner image of the photoreceptor drum 1 is attached directly to the transfer roller 3.

Now, FIG. 14 is a typical view of an arrangement in which a transfer sheet sensor is disposed just in front of a registration roller, explaining the contamination of a transfer roller caused when transfer sheets jam up.

In FIG. 14, since a transfer sheet detect sensor 5" is disposed just in front of a registration roller 9, when a transfer sheet 8 is caused to jam after the sensor 5" passes through the registration roller 9, a transfer roller 3 is contacted with a photoreceptor drum 1 with a transfer sheet held between them, with the result that, similarly to the above case, the toner image of the photoreceptor drum 1 is attached directly to the transfer roller 3.

When a developing agent degrades, the toners are stuck to the whole surface of the photoreceptor drum 1 to thereby produce a so called toner fog. As a result of this, the toners are attached to the portion of the transfer roller in which the transfer sheet does not exist during the image transferring operation.

As a transfer device which aims in preventing the back surface of the transfer sheet from being contaminated by the toners, there is known a device having a structure which is discussed below.

FIG. 15 is a typical view of a conventional transfer device in which a transfer roller is cleaned each time the transfer roller is separated from a photoreceptor drum, explaining an operation thereof in which a toner image is transferred. In FIG. 15, reference character 1 designates a photoreceptor drum serving as an image carrier, 3 a transfer roller serving as transfer means, 3*a*' a transfer roller moving lever, 3*b*' a solenoid, 3*d*' a rotary support portion, 4' a cleaning device, 4*a*' a brush, and 8 a transfer sheet.

In FIG. 15, the transfer roller 3 is mounted on the other end of the transfer roller moving lever 3*a*' with one end thereof rotatably supported by the rotary support portion 3*d*', and the solenoid 3*b*' is mounted on the transfer roller moving lever 3*a*'. Also, the cleaning device 4' is disposed at a position spaced apart from the transfer roller 3.

When a toner image carried by the photoreceptor drum 1 is transferred to the transfer sheet 8, the solenoid 3*b*' is extended in a direction of an arrow U to bring the transfer roller 3 into contact with the photoreceptor drum 1 through the transfer sheet 8.

In this state, the cleaning device 4' is separated from the transfer roller 3.

FIG. 16 is a typical view of the conventional transfer device in which the transfer roller is cleaned each time the transfer roller is separated from the photoreceptor drum, explaining an operation thereof in which the transfer roller is retreated. In FIG. 15, at a position where the transfer roller 3 is separated and retreated from the photoreceptor drum 1, the transfer roller 3 can be contacted with the cleaning device 4'.

In the transfer roller contact portion of the cleaning device 4', there is disposed the brush 4*a*' and thus, even if the transfer roller 3 is separated from the photoreceptor drum 1, if the transfer roller 3 is rotated, then the toner stuck to the transfer roller 3 can be removed.

Now, FIG. 17 is a typical view of an conventional example of a color image forming apparatus using a belt-shaped member as an intermediate transfer medium. In FIG. 17, reference character 1 stands for a photoreceptor drum, 2 a color developing device, 3 a primary transfer roller, 8 a transfer sheet, 9 a registration roller, 20 a cleaning device for a photoreceptor drum, 21 a charging device, 27 a electricity removing lamp, 28 an intermediate transfer belt, 29*a*–29*d* respectively belt provision rollers, 30 a secondary transfer roller, 31 a back-up roller, 33 a grounding roller, 34 a sheet peel-off claw, 35 a belt cleaning device, 37 a fixing device, and 38 a sheet discharge tray, respectively.

In FIG. 17, after the surface of the photoreceptor drum 1 is charged uniformly with electric charges each having a given polarity by the charger 21, an image is written into the uniformly charged surface of the photoreceptor drum 1 by a laser beam L modulated by the image information of a first color so that an electrostatic latent image corresponding to the first color image is formed.

The thus formed electrostatic latent image is then fed to the position of the developing device 2 due to the rotational movement of the photoreceptor drum 1, where the electrostatic latent image is developed with a first color toner (yellow toner) of the developing device 2 to thereby form a first color toner image T on the photoreceptor drum 1.

When the photoreceptor drum 1 is further rotated to move through the intermediate transfer belt 28 to a primary transfer portion in which the primary transfer roller 3 is disposed, the first color toner image T carried on the photoreceptor drum 1 is primarily transferred to the intermediate transfer belt 28 with a voltage having a given polarity (which is opposite to the charged polarity of the toner image) to be applied to the primary transfer roller 3.

The intermediate transfer belt 28 is provided over and wound around the provision rollers 29*a*–29*d* and back-up roller 31 and can be moved substantially at the same speed as the peripheral speed of the photoreceptor drum 1, while the intermediate transfer belt 28 rotates in synchronization with the cycle at which a second color toner image and a third color toner image are formed on the photoreceptor drum 1.

On the intermediate transfer belt 28, similarly to the above-mentioned first color toner image, there are formed a second color (cyan) toner image, a third color (magenta) toner image, and a fourth color (black) toner image in such a manner that they are sequentially superimposed on top of one another, thereby providing a full-color toner image.

Due to the rotational movement of the intermediate transfer belt 28, the full-color toner image on the intermediate transfer belt 28 is moved to a secondary transfer portion in which the secondary transfer roller 30 is disposed, and the full-color toner image is then transferred secondarily onto the transfer sheet 8 which is fed at a timing given by the registration roller 9.

The transfer sheet 8 with the toner image transferred thereto is peeled off from the intermediate transfer belt 28 by the peel-off claw 34 and is then delivered to the fixing device 37, in which the toner image of the transfer sheet 8 is fixed. After completion of this fixing operation, the transfer sheet 8 is discharged out from the fixing device 37 to the sheet discharge tray 38.

After the secondary transfer operation is ended, the intermediate transfer belt 28 is cleaned by the cleaning device 35 so that the residual toner of the intermediate transfer belt 28 is removed, and thus the intermediate transfer belt 28 is now prepared for the next transfer.

As an example of such conventional image forming apparatus, there is available an image forming apparatus which is disclosed in Japanese Patent Publication No. 6-95521.

In the above-mentioned respective conventional image forming apparatuses, in carrying out a successive transfer operation, if an interval between the transfer sheets is shorter than the outer periphery of the transfer roller or secondary transfer roller, the transfer roller or secondary transfer roller cannot be cleaned to a satisfactory degree.

In the above-mentioned prior art, in one system in which the presence or absence of the transfer sheet is detected before the transfer sheet advances into the transfer portion and, in accordance with such detection, the transfer roller or secondary transfer roller is contacted with and separated from the photoreceptor drum serving as an image carrier or the secondary transfer roller, there is still left a problem that the transfer roller or secondary transfer roller cannot be prevented against the toner contamination in a satisfactory manner.

On the other hand, in the other system in which, when the transfer roller or secondary transfer roller is separated from the photoreceptor drum or the intermediate transfer belt, the transfer roller or secondary transfer roller is cleaned, it is difficult to clean the transfer roller or secondary transfer roller to a satisfactory degree in a successive transfer process if a transfer sheet used is of a small size.

SUMMARY OF THE INVENTION

The present invention aims at eliminating the drawbacks found in the above-mentioned conventional image forming apparatuses. Accordingly, it is an object of the invention to provide an image forming apparatus which can prevent a transfer roller or a secondary transfer roller from being contaminated by a toner and, even in a successive transfer process using a transfer sheet of a small size, can clean the transfer roller or secondary transfer roller satisfactorily in a real time manner to prevent the back surface of the transfer sheet from being contaminated, thereby being always able to obtain a transfer image of a high quality.

In attaining the above object, according to the invention, a sensor (which can also be referred to as a transfer sheet detect sensor or simply a sheet sensor) for detecting the presence or absence of a transfer sheet is interposed between a point of contact in a transfer portion where a photoreceptor drum serving as an image carrier or a transfer belt (intermediate transfer belt) serving as an intermediate transfer member can be contacted with a transfer roller or a secondary transfer roller and a tucking point which is situated upstream just before the contact point and where the transfer sheet is tucked onto the photoreceptor drum or intermediate transfer belt, a cleaning device (a cleaning roller) is disposed in such a manner that it can be contacted with and retreated (separated) from the photoreceptor drum or intermediate transfer belt and also that it is contactable with the transfer roller or secondary transfer roller while the transfer roller or secondary transfer roller is retreated to its separated position, and, in a cleaning operation to be performed by the cleaning roller, a given cleaning potential can be applied to the transfer roller or secondary transfer roller.

Now, description will be given below of the structure of the present invention by giving reference characters to the respective parts thereof in order to show clear correspondence to the illustrated embodiments of the invention.

In other words, for example, as shown in FIG. 1, according to the invention, there is provided an image forming apparatus which comprises: an image carrier (photoreceptor drum) 1; a developing device 2 for developing an electrostatic latent image formed on the surface of the image carrier 1 by use of a toner to thereby provide a toner image on the image carrier 1; a transfer roller 3 which is disposed in such a manner that it can be contacted with and separated from the image carrier 1 and also which is used to transfer the toner image carried on the image carrier 1 to a transfer sheet 8 being supplied into between the image carrier 1 and the transfer roller 3; a registration roller 9 for deciding a supply timing at which the transfer sheet 8 is supplied into between the image carrier 1 and transfer roller 3 and also for feeding the transfer roller 3 to a tucking point A provided in the surface of the image carrier 1; a transfer sheet detect sensor 5 disposed upstream of a point of contact at which the image carrier 1 and transfer roller 3 are contacted with each other; a contacting and separating mechanism 6 for contacting the transfer roller 3 with the image carrier 1 and separating the transfer roller 3 from the image carrier 1; a cleaning roller 4 which, at a position spaced from its contact position with the image carrier 1, can be contacted with the transfer roller 3; a contact and separation control device 7 which controls the contacting and separating mechanism 6 in such a manner that, in accordance with a signal supplied from the transfer sheet sensor 5 for indicating that the transfer sheet is present, the mechanism 6 allows the transfer roller 3 to come into contact with the image carrier 1 and also, in accordance with a signal for indicating that the transfer sheet is absent, the mechanism 6 allows the transfer roller 3 to be separated from the image carrier 1 and come into contact with the cleaning roller 4; and, means which is used to rotationally drive at least the transfer roller and cleaning roller 4.

Also, the present image forming apparatus further includes a bias voltage apply device 12 which, when the transfer roller 3 and cleaning roller 4 are contacted with each other and are rotated together in accordance with the transfer sheet absence signal of the transfer sheet detect sensor 5, not only applies a bias potential having the opposite polarity to the charged polarity of the toner image and a bias potential having the same polarity as the toner image charged polarity to the transfer roller 3 respectively for a period of one rotation or more of the transfer roller or secondary transfer roller, but also applies a bias potential or a grounding potential to the cleaning roller 4. Here, as a simplified method, only the bias voltage having the opposite polarity to the charged polarity of the toner image may be applied to the transfer roller 3 for a period of one rotation or more of the transfer roller or secondary transfer roller.

And, the present image forming apparatus further includes transfer roller rotation speed control means which, when the transfer roller 3 and cleaning roller 4 are pressure contacted with each other in accordance with the transfer sheet absence signal of the transfer sheet sensor, controls the rotation speed of the transfer roller or secondary transfer roller to be greater than the rotation speed thereof when it comes into contact with the image carrier 1 or intermediate transfer belt 28 to transfer the toner image.

In the above-mentioned respective structures, the developing device 2 develops an electrostatic latent image formed on the surface of the image carrier 1 comprising of a photoreceptor drum by means of a toner to thereby provide a toner image on the image carrier 1.

The transfer roller 3 is disposed in such a manner that it can be contacted with and separated from the image carrier 1, and is used to transfer the toner image carried on the image carrier 1 onto the transfer sheet 8 which is supplied into between the image carrier 1 and the transfer roller 3.

The registration roller 9 not only decides the supply timing of the transfer sheet 8 to be supplied into between the image carrier 1 and the transfer roller 3 but also feeds the transfer roller 3 to a tucking point A provided in the surface of the image carrier 1.

The transfer sheet detect sensor 5 is disposed downstream of the tucking point A and upstream of a contact point B between the image carrier 1 and transfer roller 3 and is used to detect the transfer sheet 8 which advances into the transfer portion.

The contacting and separating mechanism 6 moves the transfer roller 3 between a transfer position and a retreat position to thereby make the transfer roller 3 come into contact with the image carrier 1 and separate from the image carrier 1.

The cleaning roller 4 is contacted and rotated with the transfer roller 3 at a position where the transfer roller 3 departs and retreats from its contact position with respect to the image carrier 1, thereby be able to remove the toner adhering to the transfer roller 3.

The contact and separation control device 7 controls the contacting and separating mechanism 6 in such a manner that the mechanism 6 drives the transfer roller 3 to come into contact with the image carrier 1 in accordance with the transfer sheet presence signal of the transfer sheet detect sensor 5 and also the mechanism 6 drives the transfer roller 3 to be separated from the image carrier 1 and come into pressure contact with the cleaning roller 4 in accordance with the transfer sheet absence signal of the transfer sheet sensor 5.

A drive motor 10 is a motor which is used to rotationally drive at least the transfer roller 3 and, preferably, the drive motor 10 may also have a function as a drive motor for the cleaning roller 4.

Also, the bias voltage apply device 12, when the image carrier 1 and cleaning roller 4 are pressure contacted with each other in accordance with the transfer sheet absence signal of the transfer sheet sensor, applies a bias potential having the opposite polarity to the charged polarity of the toner to the transfer roller 3 for a period of one rotation or more of the transfer roller 3 and also applies a 0 bias potential or a grounding potential to the cleaning roller 4.

Further, a drive motor control device 11, when the image carrier 1 and cleaning roller 4 are pressure contacted with each other in accordance with the transfer sheet absence signal of the transfer sheet sensor, controls the rotation speed of the drive motor to be greater than the rotation speed of the drive motor when the transfer roller is contacted with the image carrier 1 for transfer of the toner image.

The above-mentioned image forming apparatus is an image forming apparatus that employs a system in which a toner image formed in a photoreceptor drum operating as an image carrier is transferred directly to a transfer sheet. However, even in an image forming apparatus that employs a system in which a toner image formed on the image carrier 1 is once transferred onto the intermediate transfer member 28 primarily and, after then, the toner image transferred to the intermediate transfer member 28 is transferred to the transfer sheet 8 secondarily, if the transfer roller is replaced by a secondary transfer roller and the image carrier is replaced by an intermediate transfer member, then a similar cleaning operation can be performed.

In summary, image forming apparatuses according to the present invention can be described in the following manner:

(1) An image forming apparatus comprising:

an image carrier for forming thereon an electrostatic latent image corresponding to image information;

a developing device for developing the electrostatic latent image formed on the surface of the image carrier to thereby form a toner image on the image carrier;

a transfer member contactable with the image carrier through a transfer sheet to be fed for transferring the toner image carried on the image carrier;

a registration roller for deciding the supply timing of the transfer sheet to be supplied into between the image carrier and the transfer member and also for feeding the transfer sheet to a tucking point provided in the surface of the image carrier;

a transfer sheet detect sensor disposed downstream of the tucking point in the feeding direction of the transfer sheet and upstream of a contact point at which the image carrier and the transfer member are contacted with each other; and, a contacting and separating mechanism, when the transfer sheet is detected by the transfer sheet sensor, for allowing the transfer member to be contacted with the image carrier.

However, the above-mentioned transfer member is not limited to a transfer member of a roller type but a transfer member of a blade type, a transfer member of a corotron type, and a so called transfer film can also be used.

As mentioned above, since the transfer sheet detect sensor is disposed downstream of the tucking point and upstream of the contact point between the image carrier and transfer member to thereby be able to detect even a case where the transfer sheet cannot be tucked onto the image carrier, the poor transfer sheet delivery can be detected positively, which in turn makes it possible to prevent the transfer member from being contacted directly with the image carrier in error to soak up the toner therefrom. At the same time, because the contacting and separating mechanism is controlled in such a manner that it drives the transfer roller to be contacted with the image carrier in response to the transfer sheet detection by the transfer sheet detect sensor, it is possible to prevent the toner from sticking to the transfer roller.

(2) An image forming apparatus comprising:

an image carrier on which an electrostatic latent image corresponding to image information is formed;

a developing device for developing the electrostatic latent image formed on the surface of the image carrier to thereby form a toner image on the image carrier;

a transfer roller contactable with the image carrier through a transfer sheet to be fed for transferring the toner image carried on the image carrier to the transfer sheet;

a contacting and separating mechanism for contacting the transfer roller with the image carrier and separating the transfer roller from the image carrier;

a cleaning member touchable with the transfer roller at a position where the transfer roller is separated from the image carrier by the contacting and separating mechanism; and, transfer roller rotation speed control means which, when the transfer roller is in contact with the cleaning member at a position spaced apart from the image carrier, increases the rotation speed of the transfer roller over the rotation speed thereof when the transfer roller is in contact with the image carrier.

In this manner, when the transfer roller is in contact with the cleaning member at a position spaced apart from the image carrier, the rotation speed of the transfer roller is set greater than the rotation speed thereof when it is in contact with the image carrier, so that the transfer roller can be cleaned in a short time.

For this reason, even when an interval between transfer sheets of a small size supplied successively is small, the transfer roller can be cleaned satisfactorily.

(3) An image forming apparatus as set forth in the above-mentioned article (2), further including contact and separation control means which controls the contacting and separating mechanism in such a manner that the mechanism allows the transfer roller to be contacted with the image carrier at a time when the leading end of the transfer sheet in the delivery direction thereof reaches a transfer position in which the transfer roller is disposed, and also that the mechanism allows the transfer roller to be separated from the image carrier at a time when the trailing end of the transfer sheet in the delivery direction thereof departs from the transfer position.

Thanks to the present structure, since there is eliminated the possibility that the transfer roller can be contacted with the image carrier when no transfer sheet is present between the transfer roller and image carrier, there is no fear that the toner can stick to the transfer roller from the image carrier.

(4) An image forming apparatus as set forth in the above-mentioned article (2), in which the transfer roller rotation speed control means changes the transfer roller rotation speed at a time when the transfer roller is brought into contact with the cleaning member at the position spaced apart from the image carrier, in accordance with the intervals between the transfer sheets that are successively supplied into between the image carrier and transfer member.

Thanks to this, the transfer roller can be cleaned in a short time at a position spaced apart from the image carrier and thus, even when transfer sheets or the like of a small size are used and the interval between such transfer sheets is small, the transfer roller can be cleaned satisfactorily.

(5) An image forming apparatus as set forth in the above-mentioned article (2), further including bias voltage apply means, when the transfer roller is brought into contact with the cleaning member at a position spaced apart from the image carrier, applies two kinds of voltages, namely, one voltage having the same polarity and the other having the opposite polarity with respect to the polarity of the toner image carried on the image carrier onto the transfer roller respectively for a period of one rotation or more of the transfer roller.

Due to this structure, the whole surface of the transfer roller can be cleaned completely. Alternatively, a voltage having the opposite polarity to the polarity of the toner image carried on the image carrier may be applied onto the transfer roller for a period of one rotation or more of the transfer roller.

(6) An image forming apparatus comprising:

an image carrier on which an electrostatic latent image corresponding to image information is formed;

a developing device for developing the electrostatic latent image formed on the surface of the image carrier to thereby form a toner image on the image carrier; and, an intermediate transfer member for transferring primarily the toner image formed on the surface of the image carrier;

in which, after the above-mentioned primary transfer operations are performed repeatedly on the intermediate transfer member for each of a plurality of colors and toner images each of a plurality of colors are superimposed on top of one another on the intermediate transfer member, the color toner images of the plurality of colors on the intermediate transfer member are transferred secondarily in a batch to a transfer sheet, said image forming apparatus further including:

a secondary transfer roller touchable with the intermediate transfer roller through the transfer sheet for secondarily transferring the color toner image carried on the intermediate transfer member to the transfer sheet;

a registration roller for deciding the supply timing of the transfer sheet at which the transfer sheet is supplied into between the intermediate transfer member and secondary transfer roller and also for feeding the transfer sheet to a tucking point provided on the surface of the intermediate transfer member;

a transfer sheet sensor disposed downstream of the tucking point in the feeding direction of the transfer sheet and upstream of a contact point at which the intermediate transfer member and secondary transfer roller are contacted with each other; and, a contacting and separating mechanism, when the transfer sheet is detected by the transfer sheet detect sensor, for bringing the secondary transfer roller into contact with the intermediate transfer member.

According to the present image forming apparatus, since the transfer sheet sensor is disposed downstream of the tucking point and upstream of the contact point between the intermediate transfer member and transfer member to thereby be able to detect even a case where the transfer member cannot be tucked into the intermediate transfer member, poor transfer sheet delivery can be detected positively, which makes it possible to prevent the secondary transfer roller from being contacted in error with the intermediate transfer member and thus to prevent the toner from adhering to the secondary transfer roller. Also, because the contacting and separating mechanism is controlled in such a manner that the mechanism allows the secondary transfer roller to be contacted with the intermediate transfer member in accordance with the detection of the transfer sheet by the transfer sheet detect sensor, it is possible to prevent the toner from adhering to the transfer roller.

(7) An image forming apparatus comprising:

an image carrier on which an electrostatic latent image corresponding to image information is formed;

a developing device for developing the electrostatic latent image formed on the surface of the image carrier to thereby form a toner image on the surface of the image carrier; and, an intermediate transfer member for transferring primarily the toner image formed on the surface of the image carrier;

in which, after the above-mentioned primary transfer operations are performed repeatedly on the intermediate transfer member for each of a plurality of colors and thus toner images each having one of the plurality of colors are superimposed on top of one another on the intermediate transfer member, the color toner images of the plurality of colors on the intermediate transfer member are then transferred secondarily in a batch to a transfer sheet, said image forming apparatus further including:

a secondary transfer roller touchable with the intermediate transfer roller through the transfer sheet for secondarily transferring the color toner image carried on the intermediate transfer member to the transfer sheet;

a contacting and separating mechanism for contacting the secondary transfer roller with the intermediate transfer roller and separating the secondary transfer roller from the intermediate transfer roller;

a cleaning member touchable with the secondary transfer roller at a position where the secondary transfer roller is separated from the intermediate transfer member by the contacting and separating mechanism; and, secondary transfer roller rotation speed control means for increasing the rotation speed of the secondary transfer roller when the secondary transfer roller is in contact with the cleaning member at a position where the secondary transfer roller is separated from the intermediate transfer member over the secondary transfer roller rotation speed when the secondary transfer roller is in contact with the intermediate transfer member.

According to the present structure, there is eliminated the possibility that the secondary transfer roller can be contacted in error with the intermediate transfer member and the toner can be thereby caused to adhere to the secondary transfer roller. Also, since the contacting and separating mechanism is controlled such that it allows the secondary transfer roller to be contacted with the intermediate transfer member in accordance with the detection of the transfer sheet by the transfer sheet detect sensor, it is possible to prevent the toner from adhering to the secondary transfer roller.

Due to the fact that the rotation speed of the secondary transfer roller when the secondary transfer roller is in contact with the cleaning member at a position where the secondary transfer roller is separated from the intermediate transfer member is set greater than the rotation speed of the secondary transfer roller when the secondary transfer member is in contact with the intermediate transfer member, the secondary transfer roller can be cleaned in a short time.

Accordingly, even when transfer sheets of a small size or the like are used and the interval between the transfer sheets is small, the secondary transfer roller can be cleaned satisfactorily.

(8) An image forming apparatus as set forth in the above article (7), further including a contact and separation control device which controls the contacting and separating mechanism in such a manner that, at a time when the leading end of the transfer sheet in the feeding direction reaches a secondary transfer position where the secondary transfer roller is disposed, the mechanism allow the secondary transfer roller to be contacted with the intermediate transfer member, and, at a time when the trailing end of the transfer sheet in the delivery direction departs from the secondary transfer position, the mechanism allows the secondary transfer roller to be separated from the intermediate transfer member.

According to the present structure, there is eliminated the possibility that the secondary transfer roller can be contacted in error with the intermediate transfer member to thereby cause the toner to adhere to the secondary transfer roller and, at the same time, since the contacting and separating mechanism is controlled such that it allows the secondary transfer roller to be contacted with the intermediate transfer member in accordance with the detection of the transfer sheet by the transfer sheet detect sensor, the adhesion of the toner to the secondary transfer roller can be prevented.

(9) An image forming apparatus as set forth in the above article (7), further including a bias voltage apply device which, when the secondary transfer roller is contacted with the cleaning member at a position where it is separated from the intermediate transfer member, applies two kinds of voltages, one voltage having the opposite polarity and the other having the same polarity with respect to the polarity of the toner image carried on the intermediate transfer member, respectively onto the secondary transfer roller for a period of one rotation or more of the secondary transfer roller. Alternatively, a voltage having the opposite polarity to the polarity of the toner image carried on the intermediate transfer member may be applied onto the secondary transfer roller for a period of one rotation Or more of the secondary transfer roller.

Also, as the primary and secondary transfer members, the transfer members are not limited to the transfer members of a roller type that are illustrated herein, but there can also be used other kinds of transfer members such as a transfer member of a blade type, a transfer member of a corotron type, a so called transfer film, and the like.

As described above, since the transfer sheet sensor is disposed downstream of the tucking point of the intermediate transfer member and upstream of the contact point between the intermediate transfer member and secondary transfer member to thereby be able to detect even a case where the transfer sheet cannot be tucked into the intermediate transfer member, there is eliminated the possibility that the transfer member can be contacted in error with the intermediate transfer member to cause the toner to adhere to the transfer member.

Accordingly, because, when the secondary transfer member is contacted with the cleaning member, one of the potentials (a positive potential and a negative potential), that is, the potential having the opposite polarity to the charged polarity of the toner image is applied onto the secondary transfer roller at least for a period of one rotation or more of the secondary transfer roller, the positive polarity toner or negative polarity toner on the intermediate transfer member can be cleaned easily over the whole periphery of the secondary transfer roller.

Also, an AC voltage can also be added to the bias voltage to be applied onto the transfer roller or secondary transfer roller.

However, the invention is not limited to the above-mentioned structures but can also be applied similarly to other various types of image forming apparatuses using an image carrier, an intermediate transfer member and the like. Further, the invention can also be applied similarly to both of a single color image forming apparatus and a multi-color image forming apparatus.

DETAILED DESCRIPTION OF THE PREFERRED EMBODIMENTS

Now, description will be given below in detail of embodiments of an image forming apparatus according to the invention with reference to the accompanying drawings.

Figure 1:
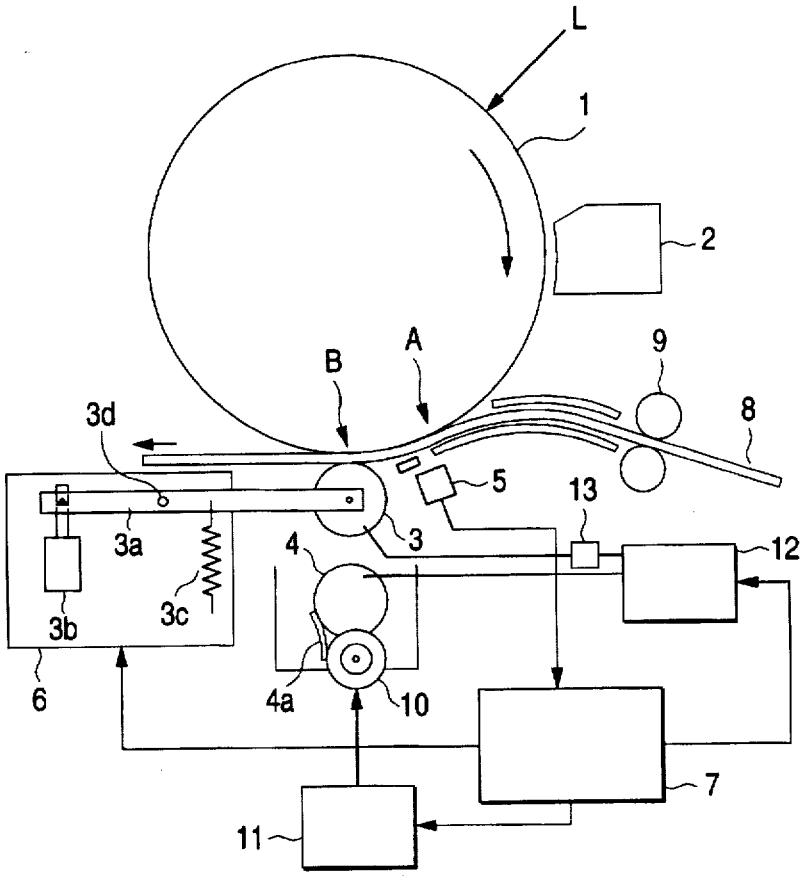
FIG. 1 is a typical view of the main portions of the structure of a first embodiment of an image forming apparatus according to the invention.

FIG. 1 is a typical view of the main portions of a first embodiment of an image forming apparatus according to the invention. In FIG. 1, reference character 1 designates a photoreceptor drum, 2 a developing device, 3 a transfer roller, 3*a* a transfer roller moving lever, 3*b* a solenoid, 3*c* a spring, 3*d* a rotary support portion, 4 a cleaning roller, 5 a transfer sheet detect sensor, 6 a contacting and separating mechanism, 7 a contact and separation control device, 8 a transfer sheet, 9 a registration roller, 10 a drive motor, 11 a drive motor control device forming a rotation control device which controls the rotation of the transfer roller and cleaning roller, and 12 a bias voltage apply device, respectively.

In FIG. 1, the surface of the image carrier (which is hereinafter referred to as a photoreceptor drum) is electrically charged uniformly and an electrostatic latent image is formed on the uniformly charged surface of the photoreceptor drum by scanning a laser beam L which is modulated by an image signal.

The electrostatic latent image is developed and visualized at the position of the developing device 2 with a toner which is charged so as to have a given polarity, thereby forming a toner image on the photoreceptor drum 1, and the thus formed toner image is carried by the photoreceptor drum 1.

The toner image, when it is rotated to a transfer portion in which the transfer roller 3 is disposed, is transferred from the photoreceptor drum 1 to the transfer sheet 8 which is delivered from the registration roller 9 to a timing at which the toner image reaches the transfer portion.

While the transfer sheet 8 is waiting in the registration roller 9, the transfer roller 3 is held at a position where it can be contacted with the cleaning roller 4 and cleaned by the same. And, when the transfer sheet 8 is delivered into the transfer portion by the registration roller 9, in accordance with a signal indicating that the transfer sheet sensor 5 has detected the presence of the transfer sheet, the contact and separation control device 7 operates the contacting and separating mechanism 6 to drive the transfer roller 3 to a position where it is contacted with the photoreceptor drum 1.

The transfer sheet detect sensor 5 is disposed not only downstream of a tucking point A at which the transfer sheet 8 touches the surface of the photoreceptor drum 1 for the first time but also downstream of a contact point B at which the photoreceptor drum 1 and transfer roller 3 are pressure contacted with each other, and the transfer sheet detect sensor 5 is arranged such that it detects the transfer sheet 8 at a time when the transfer sheet 8 is securely fed to the transfer portion.

In a state in which the transfer sheet 8 is held between the photoreceptor drum 1 and transfer roller 3, if a given transfer voltage is applied onto the transfer roller 3 a given time late, then the toner image carried on the photoreceptor drum 1 is electrostatically transferred to the transfer sheet 8.

If the transfer of the toner image is completed and the delivery of the transfer sheet 8 from the transfer portion is confirmed through a signal indicating that the transfer sheet detect sensor 5 detects the absence of the transfer sheet, then the contact and separation control device 7 operates the contacting and separating mechanism 6 in accordance with the transfer sheet absence detect signal to thereby rotate the transfer roller 3 in a direction to depart from the photoreceptor drum 1 just before the transfer sheet 8 passes through the contact point B.

The contacting and separating mechanism 6 comprises a transfer roller moving lever 3*a*, at one end of which the solenoid 3*b* is mounted and at the other end of which the transfer roller 3 is mounted, and a spring 3*c* which normally energizes the transfer roller moving lever 3*a* toward the cleaning roller 4 side. And, the contacting and separating mechanism 6 is arranged such that, if driven by the solenoid 3*b*, the transfer roller moving lever 3*a* is rotated about the rotary support portion 3*d* to thereby allow the transfer roller 3 to be contacted with and separated from the photoreceptor drum 1.

On the other hand, the cleaning roller 4 is disposed in such a manner that it can be contacted with the transfer roller 3 and rotated together at the retreat position of the transfer roller 3 where the transfer roller 3 is separated from the photoreceptor drum 1; that is, due to the contact and rotation of the transfer roller 3 and cleaning roller 4, foreign matters such as a toner, paper powder and the like stuck to the surface of the transfer roller 3 can be moved to the cleaning roller 4, and the foreign matters are then scraped off and cleaned by a blade 4*a* which is provided in contact with the cleaning roller 4.

In the cleaning operation of the transfer roller 3, the contact and separation control device 7 gives an output instruction for a cleaning bias voltage to the bias voltage apply device 12 so that the device 12 not only applies two kinds of bias potentials, which are a positive potential and a negative potential generated alternately and repeatedly, respectively to the transfer roller 3 for a period of one rotation or more of the transfer roller 3 but also applies a 0 bias potential to the cleaning roller 4.

For example, there is executed at least one time an operation in which, for the first rotation of the transfer roller, the positive potential is applied and, for the next rotation thereof, the negative potential is applied.

As a simplified method, only the bias voltage of one polarity may be applied to the transfer roller during at least one rotation of the transfer roller.

At the same time, the contact and separation control device 7 gives a speed control signal from the drive motor control device 11 serving as a rotation control device to thereby control the rotation speed of the transfer roller 3 to be greater than the rotation speed thereof when the toner image is transferred.

Thanks to this structure, each time the transfer sheet detect sensor 5 detects the absence of the transfer sheet, the whole periphery of the transfer roller 3 can be cleaned to thereby prevent the transfer roller 3 from being contacted directly with the photoreceptor drum 1 when no transfer sheet is present. Also, since the transfer roller 3 is always able to touch the transfer sheet in a clean condition, there is no possibility that the back surface of the transfer sheet can be contaminated.

Alternatively, there can be employed a structure in which the transfer roller 3 and cleaning roller 4 are respectively driven by four separate motors.

Figure 2:
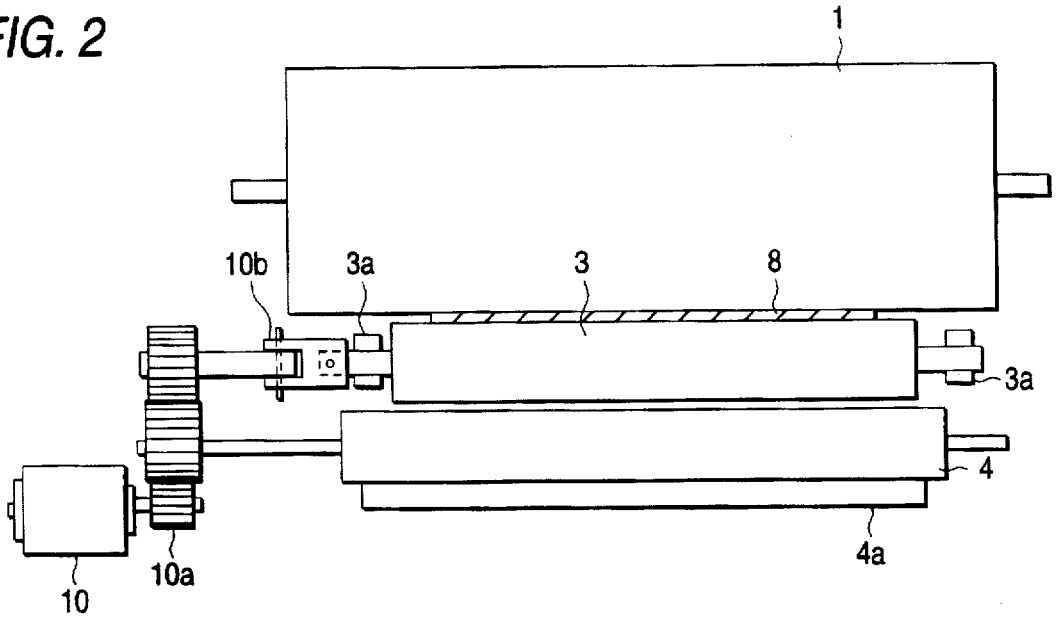
FIG. 2 is a side view of the main portions of the structure of the first embodiment shown in FIG. 1 of an image forming apparatus according to the invention.

Now, FIG. 2 is a side view of the main portions of the first embodiment shown in FIG. 1, explaining the structure of an image forming apparatus according to the invention. In FIG. 2, reference character 10*a* designates a gear, while 10*b* stands for a universal joint. Also, in FIG. 2, the same reference characters as shown in FIG. 1 designate parts which correspond to the same parts shown in FIG. 1.

In FIG. 2, the transfer roller 3 is rotationally driven by the gear 10*a* through the universal joint 10*b* in such a manner that the transfer roller 3 is moved upwardly and downwardly in FIG. 2 with respect to the photoreceptor drum 1 to be pressure contacted with the photoreceptor drum 1 through the transfer sheet 8 and separated from the photoreceptor drum 1 through the transfer sheet 8.

The drive motor 10 rotationally drives the transfer roller 3 and cleaning roller 4 through the gear 10*a* and, even when the transfer roller 3 is removed from its pressure contact with the photoreceptor drum 1, the drive motor 10 can drive the transfer roller 3 to rotate.

Figure 3:
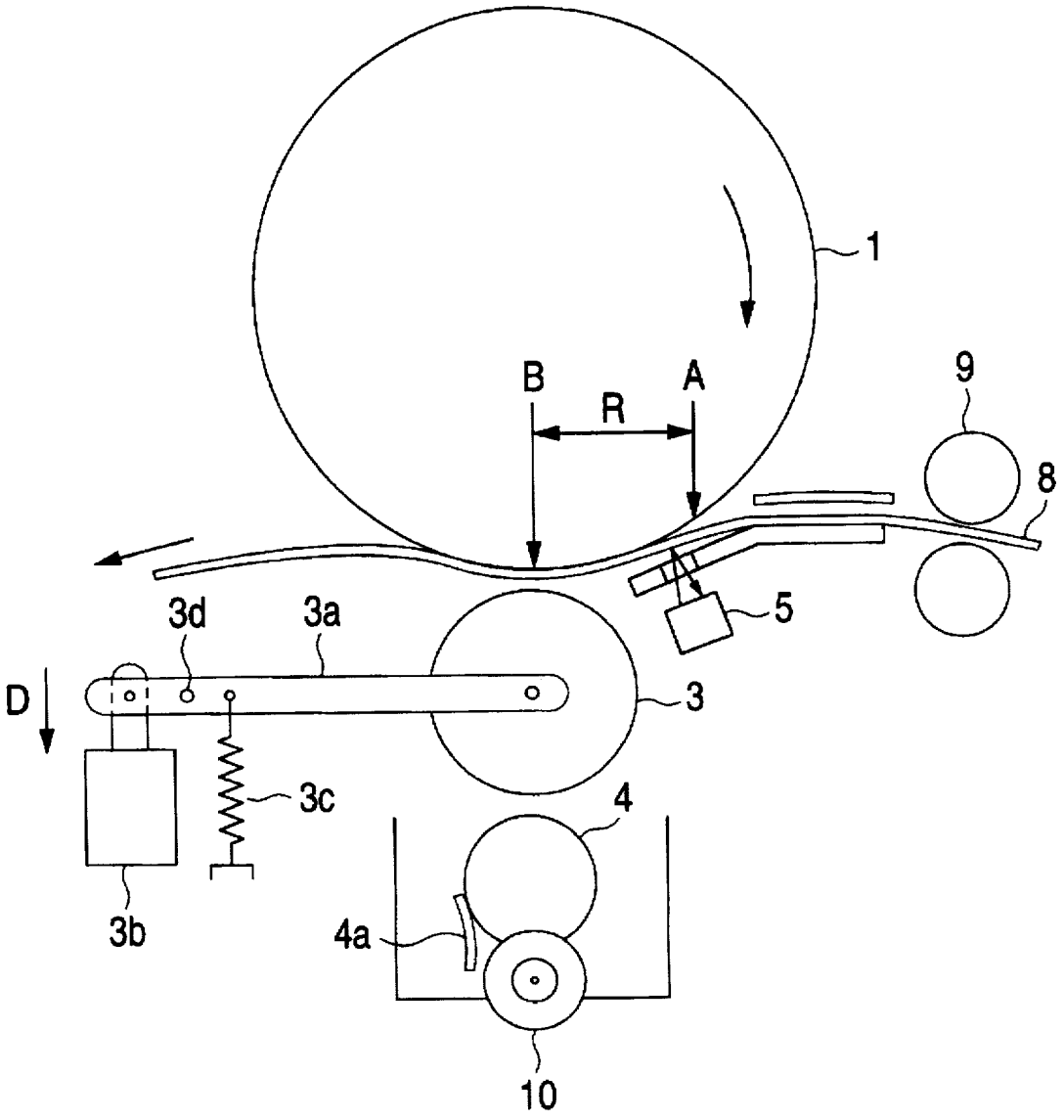
FIG. 3 a typical view of the main portions of the first embodiment of an image forming apparatus according to the invention, showing how a toner image is transferred when a transfer roller is in pressure contact with a photoreceptor drum.

Now, FIG. 3 is a typical view of the main portions of the first embodiment of an image forming apparatus according to the invention, illustrating how the toner image is transferred while the transfer roller is in pressure contact with the photoreceptor drum. In FIG. 3, the same reference characters as in FIG. 1 correspond to the equivalent parts to those shown in FIG. 1.

As shown in FIG. 3, when the toner image is transferred, since the solenoid 3*b* of the contacting and separating mechanism is driven in a direction of an arrow D, the transfer roller 3 is pressure contacted with the photoreceptor drum 1 through the transfer sheet 8 and is rotationally driven.

A transfer sheet detect sensor 5, which is an optical sensor of a reflection type, outputs a transfer sheet presence signal when the transfer sheet 8 is present in a range R, which extends between a tucking point A where the transfer sheet 8 touches the surface of the photoreceptor drum 1 for the first time and a contact point B at which the photoreceptor drum 1 and transfer roller 3 are pressure contacted with each other, while the transfer roller 3 is in such a pressure contact condition as shown in FIG. 3.

However, the transfer sheet detect sensor is not limited to the above-mentioned optical sensor but other proper known sensors can also be employed for this purpose.

Figure 4:
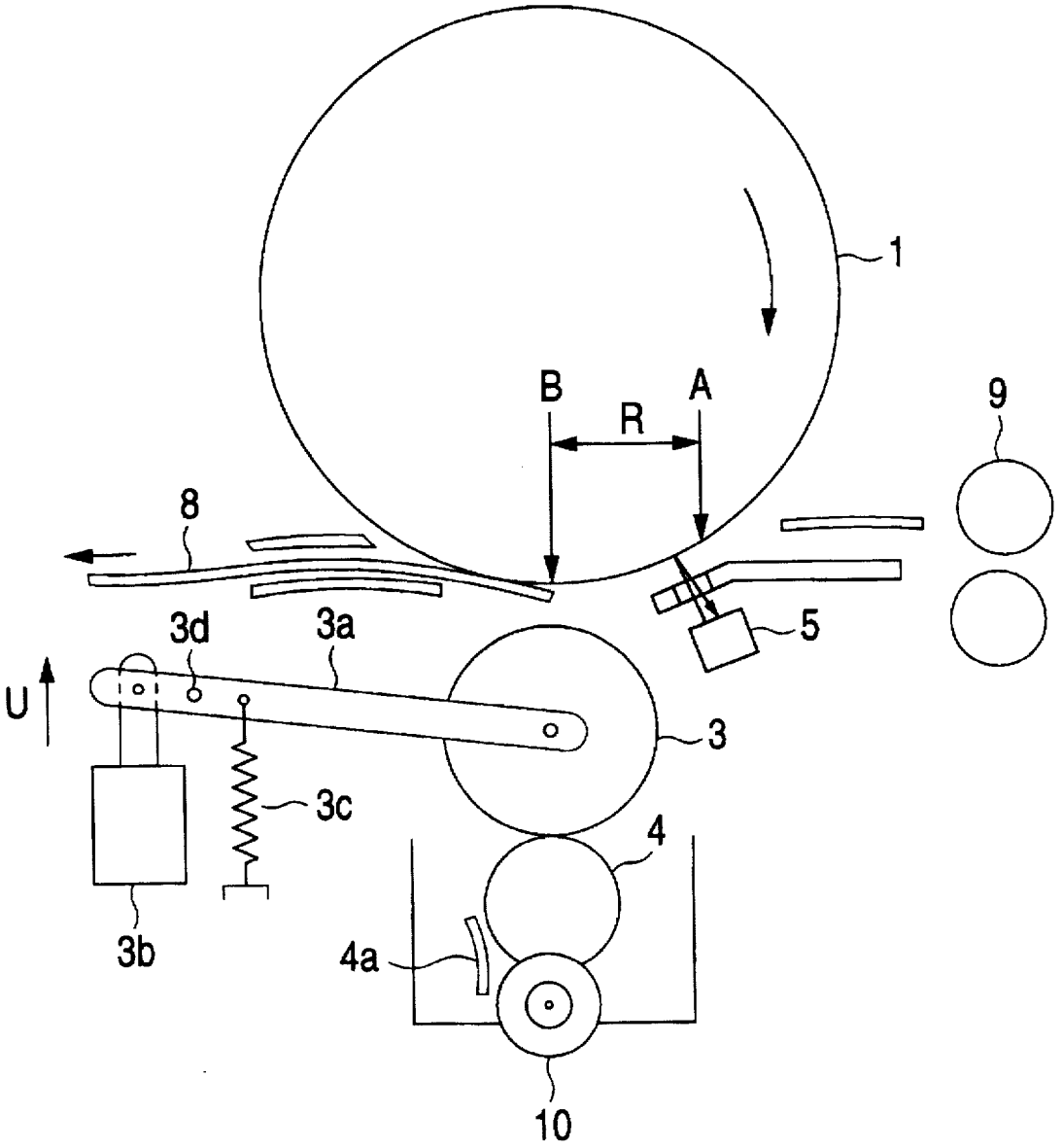
FIG. 4 is a typical view of the main portions of the first embodiment of an image forming apparatus according to the invention, showing how the transfer roller is cleaned after it is separated from the photoreceptor drum.

FIG. 4 is a typical view of the first embodiment of an image forming apparatus according to the invention, showing how the transfer roller is separated from the photoreceptor drum and is cleaned. In FIG. 4, the same reference characters as in FIG. 1 correspond to the same parts as shown in FIG. 1.

As shown in FIG. 4, if the transfer sheet 8 passes through the position of the transfer sheet detect sensor 5 disposed between a tucking point A at which the transfer sheet 8 touches the surface of the photoreceptor drum 1 for the first time and a contact point B at which the photoreceptor drum 1 and transfer roller 3 are pressure contacted with each other, then the transfer sheet detect sensor 5 outputs a transfer sheet absence signal. In accordance with the transfer sheet absence signal, the solenoid 3*b* is driven in a direction of an arrow U, so that the transfer roller 3 is driven to its retreat position (its separated position).

And, the transfer roller 3 is pressure contacted by the spring 3*c* with the cleaning roller 4 and is rotated together, with the result that foreign matters such as a toner, paper powder and the like adhering to the surface of the transfer roller 3 can be removed therefrom.

As previously shown in FIG. 2, the blade 4*a* is in sliding contact with the cleaning roller 4, that is, in the range thereof covering at least the greatest width of the transfer sheet 8. The blade 4*a* scrapes off the foreign matters such as the toner, paper powder and the like that have been moved from the transfer roller 3 to the cleaning roller 4, thereby being able to keep the cleaning roller 4 clean.

A time extending from when the transfer sheet detect sensor 5 detects the transfer sheet absence to when the transfer roller 3 is separated from the photoreceptor drum 1 is controlled to be just before the trailing end of the transfer sheet 8 departs from the contact point B after at least the whole of the toner image formed on the photoreceptor drum 1 is transferred to the transfer sheet 8. This control may be carried out by making use of the operation delay time of the contacting and separating mechanism 6, or can be executed by providing a proper timer in the contact and separation control device 7.

In the present embodiment, when the transfer roller 3 is pressure contacted with the cleaning roller 4 and is cleaned thereby, the transfer roller 3 is rotated at a higher speed than the rotation speed of the transfer roller 3 when the toner image is transferred to the transfer roller 3.

Figure 5A:
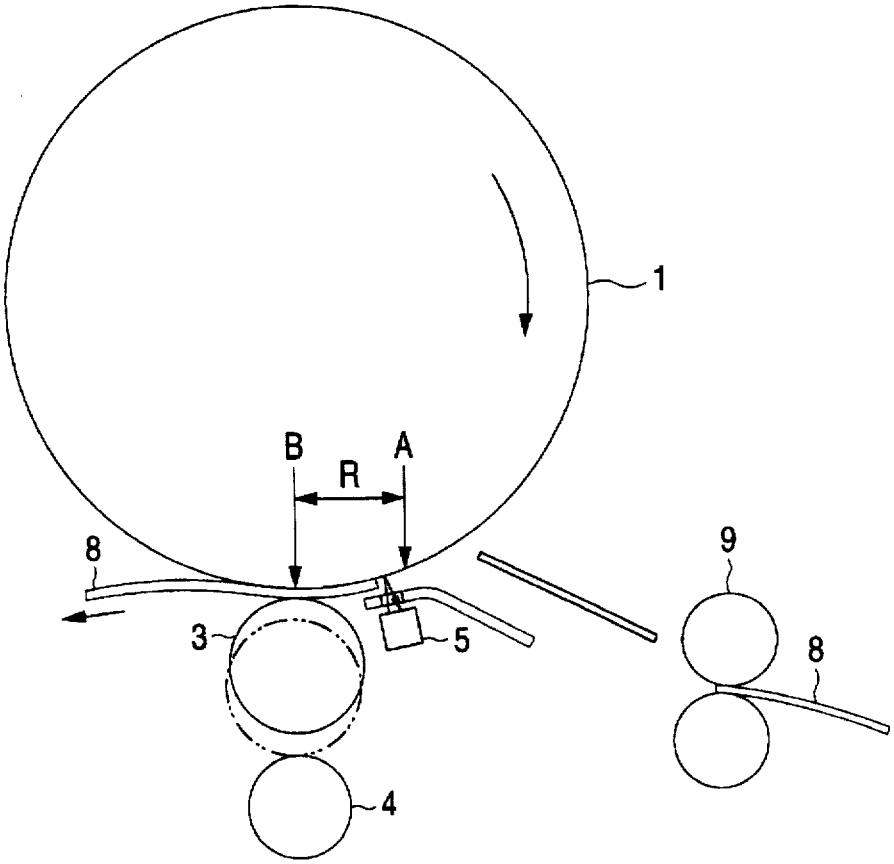
FIG. 5A and FIG. 5B are typical views of the main portions of the first embodiment of an image forming apparatus according to the invention, showing the installation position of a transfer sheet detect sensor and how the transfer roller is cleaned.
Figure 5B:
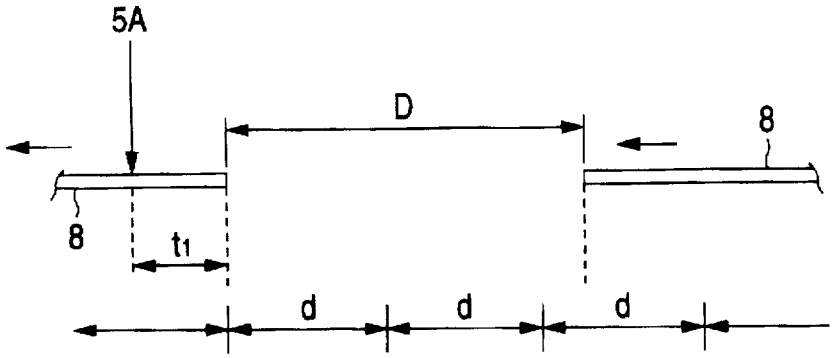

Now, FIG. 5 is a typical view of the main portions of the first embodiment of an image forming apparatus according to the invention, illustrating the installation position of the transfer sheet detect sensor and the cleaning of the transfer roller; in particular, FIG. 5A is a typical view of the main portions thereof, while FIG. 5B is a cleaning timing view thereof.

As shown in FIG. 5A, when the toner image is transferred to the transfer sheet 8 and the transfer sheet then departs from the transfer portion, a detect signal indicating the transfer sheet absence is output at a time when the trailing end of the transfer sheet departs from the position of the transfer sheet detect sensor 5. As shown in FIG. 5B, the transfer sheet absence detect signal 5A is output just before the trailing end of the transfer sheet departs from the contact point B, and, after a time t1, the transfer roller 3 is contacted with the cleaning roller 4 so that the cleaning of the transfer roller 3 can be executed by the cleaning roller 4. In this cleaning operation, during a period of an interval D between the current and next transfer sheets in a successive copying process in which the transfer sheets are fed successively, the transfer roller is rotated in such a manner that the outer peripheral length d of the transfer roller 3 is rotated at least two times.

And, during a period of one rotation or more of the above-mentioned two rotations, a cleaning bias voltage having one polarity (for example, a positive potential) is applied to the transfer roller 3, while a cleaning bias voltage having the other polarity (for example, a negative potential) is applied to the transfer roller during a period of the remaining one rotation or more thereof. The cleaning of the transfer roller 3 is carried out by performing this operation repeatedly at least one time.

Before the transfer cycle is started, by carrying out a cleaning operation in which the above-mentioned cleaning bias voltages consisting of repetition of the positive and negative potentials are applied to the transfer roller 3 for a required period of time, the transfer roller 3 is cleaned.

Figures 6A, 6B, 6C, 6D, 6E, 6F:
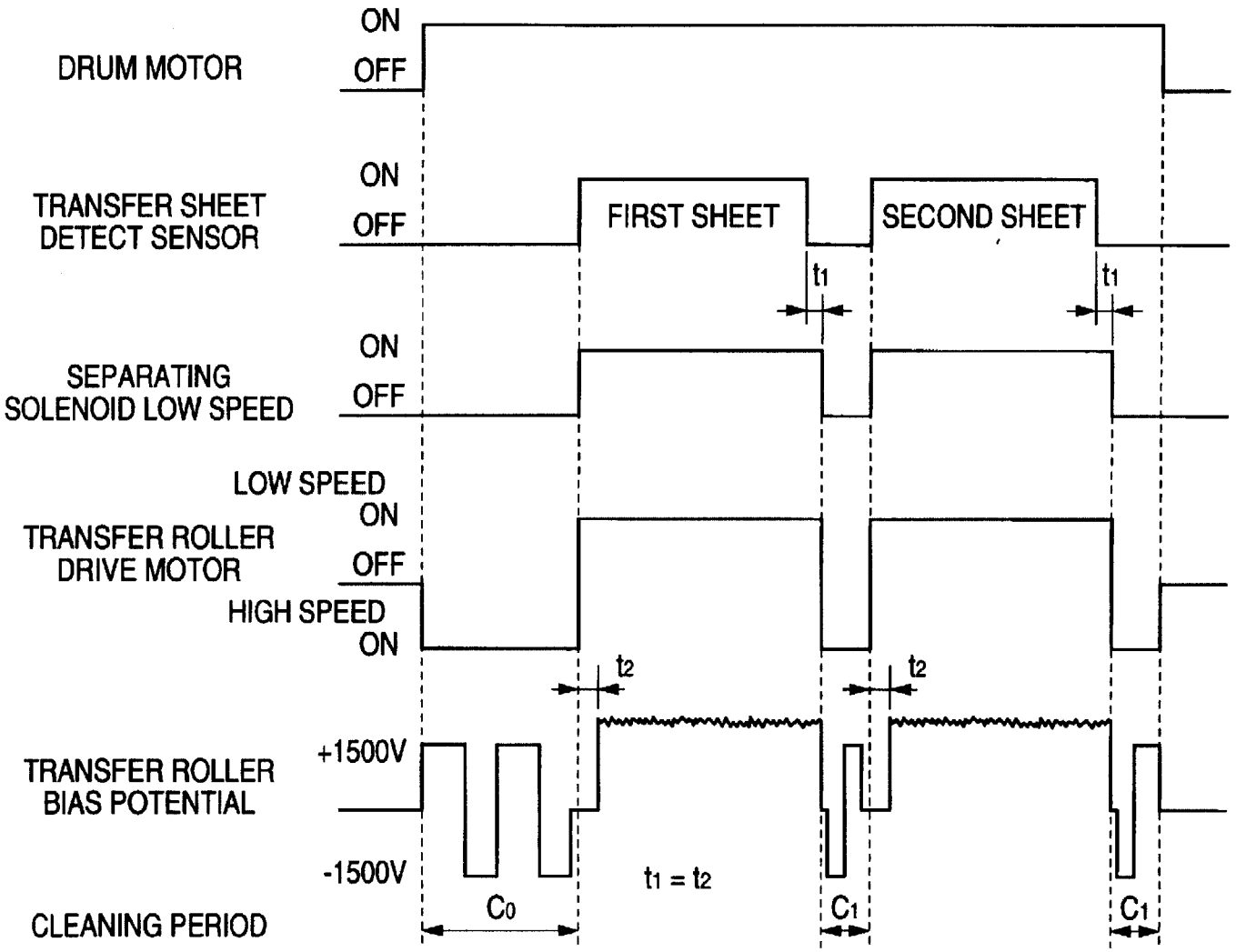
FIGS. 6A through 6B are timing charts to show the sequence of image formation and cleaning to be carried out in the first embodiment of an image forming apparatus according to the invention.

Now, FIG. 6 is a timing chart of the sequence of the image formation and cleaning to be performed in the first embodiment of an image forming apparatus according to the invention. In particular, FIG. 6A shows the timing of the operation of a drum motor which rotates the photoreceptor drum, FIG. 6B shows that of the transfer sheet detect sensor which detects the advance of the transfer sheet detect sensor into the transfer portion, FIG. 6C shows that of a separating solenoid which separates the transfer roller from the cleaning roller, FIG. 6D shows that of a drive motor (transfer roller drive motor) which drives the transfer roller and cleaning roller, FIG. 6E shows that of a transfer roller bias potential, and FIG. 6F shows a cleaning period in which the transfer roller is cleaned.

In FIG. 6, if the image forming cycle of the image forming apparatus starts, then the drum motor is driven to thereby start the rotation of photoreceptor drum 1 and, at the same time, the rotation of the transfer roller drive motor 10 is started at a high speed (that is, the motor 10 is rotated at a cleaning speed).

In this condition, the separating solenoid 3*b* is switched off and the transfer roller 3 is pressed against the cleaning roller by the spring 3*c*.

At the same time, cleaning bias voltages (in which a positive potential and a negative potential, for example, +1500 V and −1500 V are repeated) are applied to the transfer roller 3 from the bias voltage apply device 12 while the transfer roller 3 is rotated once or more, and a bias voltage consisting of a 0 potential or a grounding potential is applied to the cleaning roller 4; this operation is repeated two or more times (for example, twice).

Due to the above, the initial cleaning of the transfer roller 3, that is, a pre-cleaning Co is executed.

When the image forming cycle starts, that is, an electrostatic latent image is formed in the photoreceptor drum 1 and the transfer sheet 8 (the operation timing of which is controlled by the registration roller) reaches the transfer sheet detect sensor 5 just before a developed toner image arrives at the transfer portion so that the transfer sheet detect sensor 5 detects the presence of the transfer sheet, then the separating solenoid 3*b* is switched on and the transfer roller drive motor 10 is rotated at a low speed (that is, the motor 10 is driven for transfer rotation) in accordance with the transfer sheet presence signal.

At the same time, a transfer voltage is applied to the transfer roller 3 a time t2 late (the time t2 is a time necessary for the transfer sheet 8 to reach the point B), so that the toner image is transferred to the transfer roller 3.

If the transfer of the toner image to a first transfer sheet is completed and the transfer sheet detect sensor 5 detects the trailing end of the first transfer sheet 8 (that is, the transfer sheet detect sensor 5 detects the absence of the transfer sheet in which no detect output is issued), then the separating solenoid 3*b* is driven off after a time t1 which is a time necessary from when the transfer sheet detector sensor 5 detects the transfer sheet 8 to when the transfer sheet 8 reaches the point B. At the same time, the transfer roller drive motor 10 is rotated at a high speed, while the transfer roller bias potential is switched into the cleaning bias potential and the cleaning roller 4 is switched into the 0 bias or grounding potential, so that the cleaning operation of the transfer roller 3 is carried out for a period of two or more rotations of the transfer roller 3 (that is, +1500 V is applied one or more times, and −1500 V is applied one or more times) (C1).

After then, if the transfer sheet detect sensor 5 detects the next transfer sheet, then the separating solenoid 3*b* is switched on again to drive the transfer roller 3 in a direction in which the transfer roller 3 is pressure contacted with the photoreceptor drum 1, thereby carrying out the transfer of the toner image in a similar manner to the above case.

By repeating the above-mentioned operations each time the transfer sheet 8 advances into the transfer portion, the transfer sheet cleaning between the transfer sheets is executed.

Figure 7:
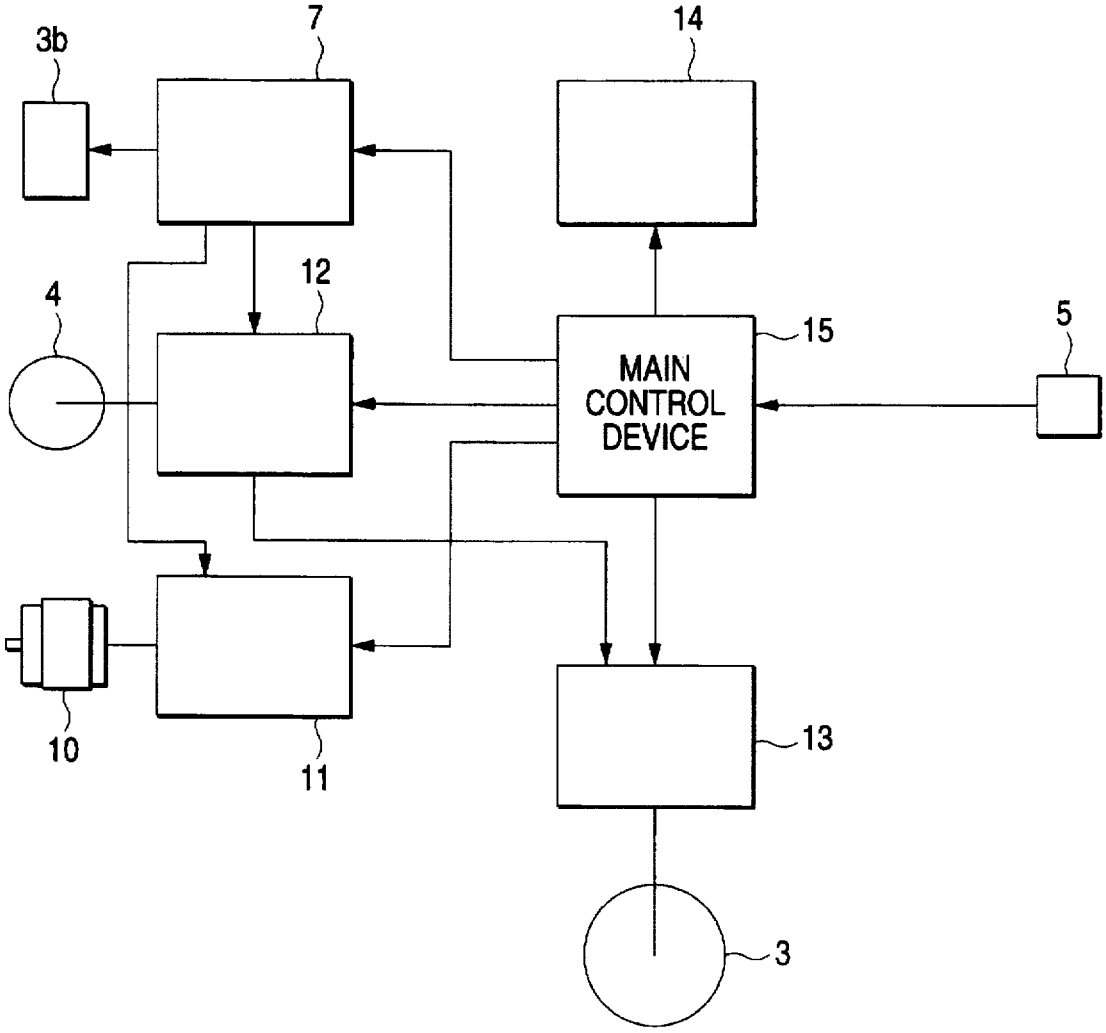
FIG. 7 is a control block view for carrying out the sequence of the cleaning operation in the first embodiment of an image forming apparatus according to the invention.

Now, FIG. 7 is a control block diagram of the first embodiment of an image forming apparatus according to the invention, showing the sequence of the cleaning operation. In FIG. 7, reference character 13 designates a transfer power source control device for controlling a transfer voltage to be applied to the transfer roller, 14 a image forming portion control device for controlling the image forming portion of the image forming apparatus, and 15 a main control device. In FIG. 7, the same reference characters as in the previously described figures correspond to the same parts in such figures.

Figure 8:
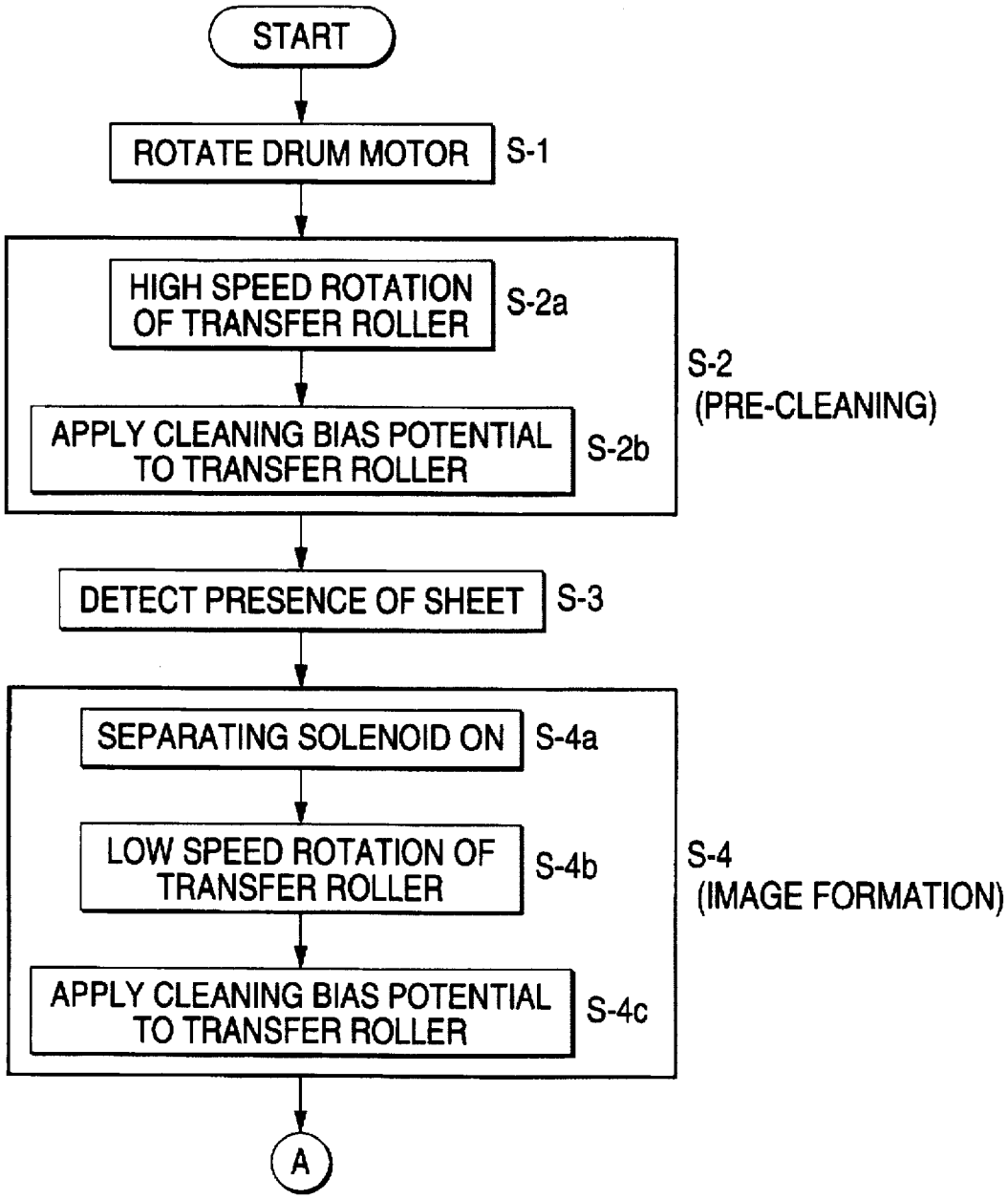
FIG. 8 is a partial flow chart to show a transfer roller cleaning sequence to be controlled by the control block shown in FIG. 7.
Figure 9:
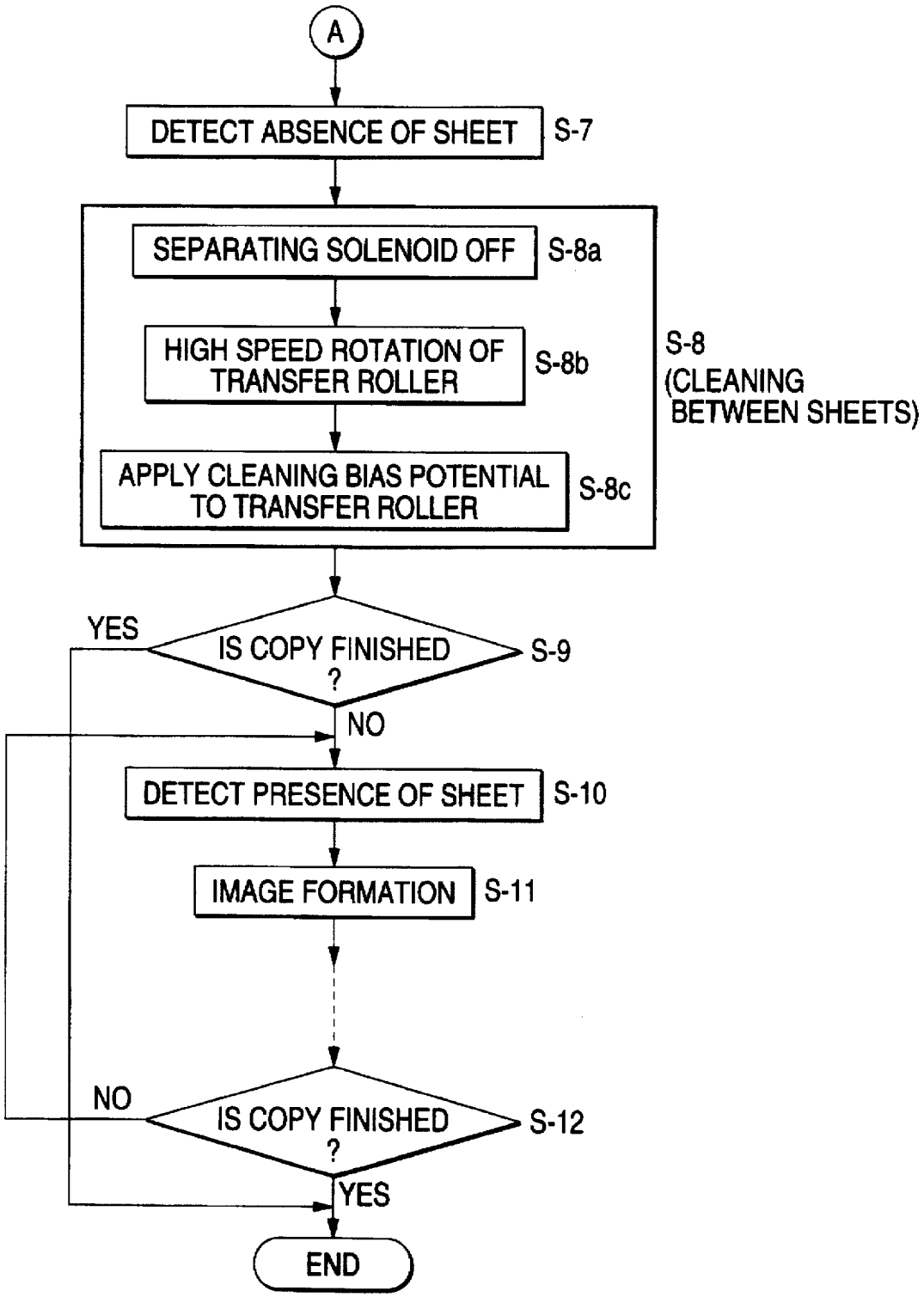
FIG. 9 is a partial flow chart continuing from the flow chart shown in FIG. 8 to show the transfer roller cleaning sequence to be controlled by the control block shown in FIG. 7.

Also, FIGS. 8 and 9 are respectively flow charts to explain the cleaning sequence of the transfer roller to be controlled by the control block shown in FIG. 7.

Description will be given below of the operation of the control block shown in FIG. 7 with reference to the flow charts in FIGS. 8 and 9.

In FIG. 7, the image forming control device 14 controls the electrostatic latent image formation of the photoreceptor drum 1, the toner image formation, and other image formations, as has been discussed in FIG. 6.

The main control device 15 controls the image forming portion control device 14 and, in accordance with the outputs of the transfer sheet detect sensor 5, instructs the contacting and separating control device 7, drive motor control device 11, bias voltage apply device 12 and transfer power source control device 13 on the execution of the cleaning control of the transfer roller 3 in the following manner. Here, alternatively, the transfer roller 3 transfer voltage apply means and the cleaning potential apply means are united into common voltage apply means such that the common voltage apply means can apply the respective voltages for the transfer and cleaning operations separately.

That is, if the copying operation of the image forming apparatus starts, then the drum motor is rotated (S-1), the drive motor control device 11 rotates the transfer roller 3 at a high speed (S-2*a*), and the bias voltage apply device 12 applies a cleaning bias potential to the transfer roller 3 and cleaning roller 4 (S-2*b*) to thereby carry out a pre-cleaning operation (S-2).

If the transfer sheet detect sensor 5 detects transfer sheet presence (S-3), then the contact and separation control device 7 operates the separating solenoid 3*b* on (S-4*a*) to thereby not only drive the transfer roller 3 into pressure contact with the photoreceptor drum 1 but also rotate the transfer roller at a low speed (S-4*b*), while the transfer bias voltage to allow the toner image formed on the photoreceptor drum 1 to be transferred to the transfer sheet 8 is applied to the transfer roller (S-4*c*), thereby carrying out an image forming operation (S-4).

If the transfer on the first transfer sheet is ended and the transfer sheet detect sensor 5 detects the absence of the transfer sheet (S-7), then the separating solenoid 3*b* is driven off (S-8*a*) to thereby rotate the transfer roller 3 at a high speed (S-8*b*) and apply a cleaning bias voltage to the transfer roller 3 (S-8*c*), thereby carrying out a cleaning operation between the transfer sheets (S-8).

Here, if copy end is set in the main control device 15 (that is, a sheet of copy is required), the processing is ended. However, when the execution of a plurality of copies is set in the main control device 15 (S-9), if the transfer sheet detect sensor 5 detects the presence of the transfer sheet (S-10), then similar image forming operations to the above-mentioned image forming operation (S-4) are to be executed (S11).

After then, the required number of copying operations and the required number of inter-sheet cleaning operations are carried out and, if the copies set are ended (S-12), then the processing is ended.

In this manner, the cleaning of the transfer roller is carried out to thereby remove foreign matters such as a toner and the like stuck to the transfer roller and, at the same time, the transfer roller can be cleaned satisfactorily at a real time even in a successive transfer process using a transfer sheet of a small size, thereby preventing the back surface of the transfer sheet from being contaminated.

Figure 10:
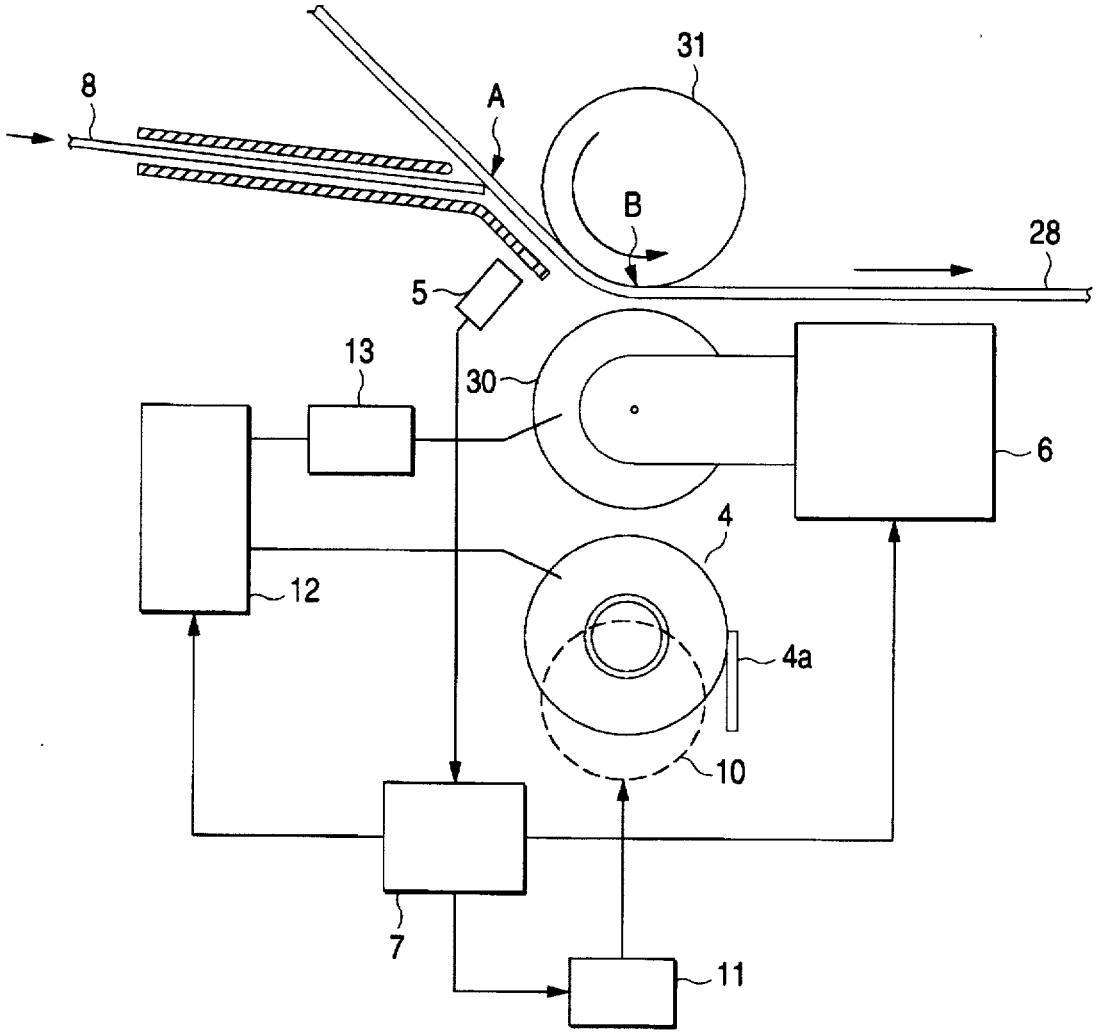
FIG. 10 is a typical view of the main portions of the structure of a second embodiment of an image forming apparatus according to the invention.

Now, FIG. 10 is a typical view of the main portions of the structure of another embodiment of an image forming apparatus according to the invention, in particular, FIG. 10 shows an example of a full-color image forming apparatus which uses a belt-shaped member as an intermediate transfer member.

In FIG. 10, reference character 28 designates an intermediate transfer belt which, as has been previously described, is extended over and wound around the belt provision roller and a back-up roller 31 and can be rotationally moved in a direction of an arrow shown in FIG. 10.

Also, 4 stands for a cleaning roller, 5 a transfer sheet detect sensor, 6 a contacting and separating mechanism, 7 a contact and separation control device, 8 a transfer sheet, 9 a registration roller, 10 a drive motor, 11 a drive motor control device which forms a rotation control device for controlling the rotation of the transfer roller 3 and the cleaning roller 4, 12 a bias voltage apply device, 30 a secondary transfer roller, and 31 a back-up roller, respectively.

A first color toner image, a second color toner image, a third color toner image and a fourth color toner image are sequentially transferred primarily on the intermediate transfer belt 28 by an image carrier (photoreceptor drum) in such a manner that they are sequentially superimposed on top of one another, so that a full-color toner image is formed on the intermediate transfer belt 28.

Figure 17:
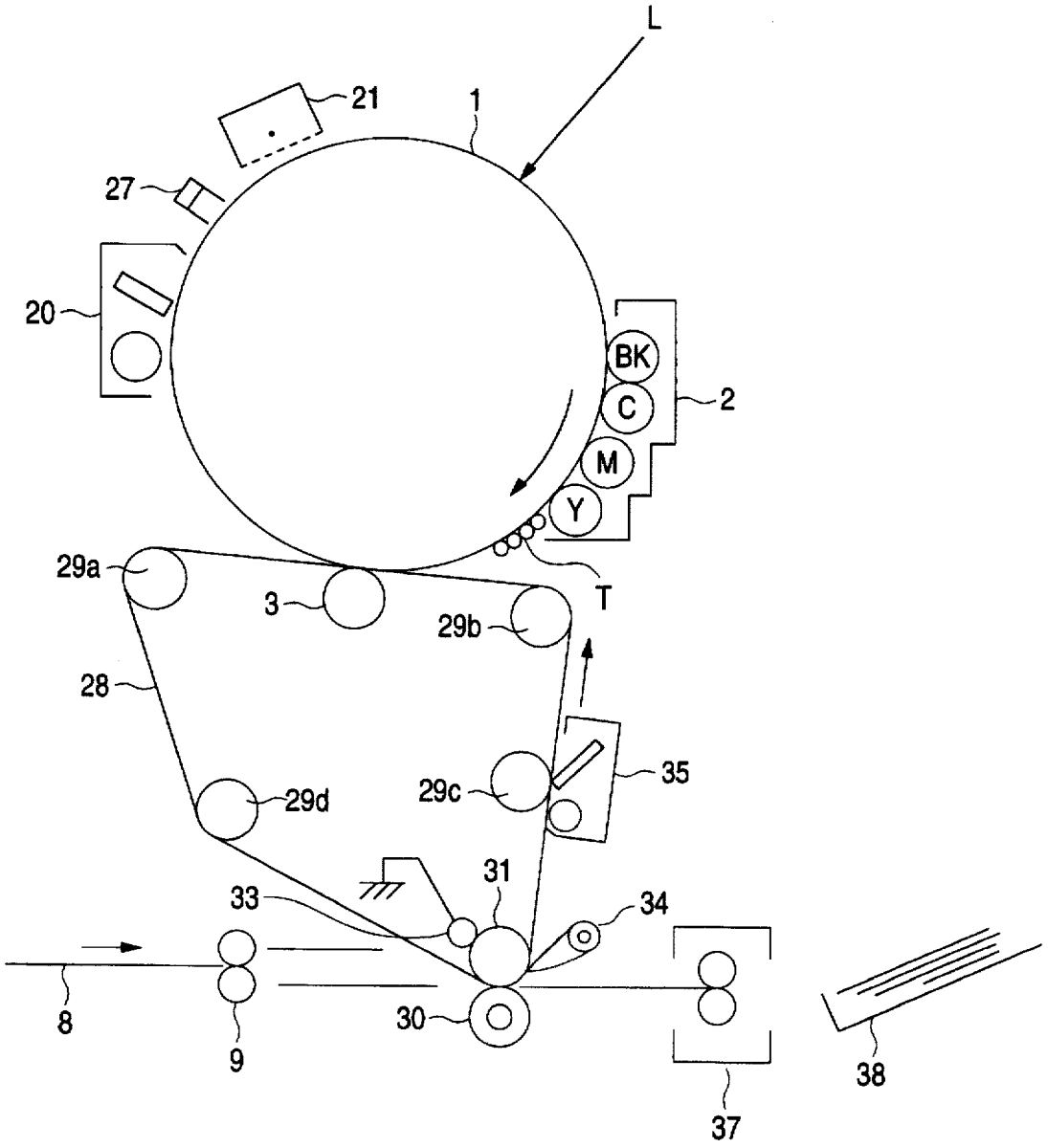
FIG. 17 PRIOR ART

When the thus formed full-color toner image is then rotated to the transfer portion in which the secondary transfer roller 30 is disposed, the full-color toner image is transferred to the transfer sheet 8 which is delivered from the registration roller 9 (see FIG. 17) to the timing of arrival of the full-color toner image at the transfer portion.

When the transfer sheet 8 waits in the registration roller 9, the secondary transfer roller 30 is held at a position where it can be contacted with and cleaned by the cleaning roller 4. And, when the transfer sheet 8 is delivered into the transfer portion by the registration roller 9, in accordance with a signal indicating that the transfer sheet detect sensor 5 detects transfer sheet presence, the contact and separation control device 7 operates the contacting and separating mechanism 6 to thereby drive the secondary transfer roller 30 to a position at which it can be pressure contacted with the intermediate transfer belt 28.

The above-mentioned transfer sheet detect sensor 5 is disposed downstream of a tucking point A at which the transfer sheet 8 is contacted with the surface of the intermediate transfer belt 28 for the first time and upstream of a contact point B at which the intermediate transfer belt 28 and secondary transfer roller 30 are pressure contacted with each other, and also the transfer sheet detect sensor 5 is arranged so as to detect the transfer sheet at a time when the transfer sheet 8 is fed t We transfer portion positively.

With the transfer sheet 8 held between the intermediate transfer belt 28 and secondary transfer roller 30, if a given transfer voltage is applied to the secondary transfer roller 30 a given time late, then the toner image carried on the intermediate transfer belt 28 can be transferred to the transfer sheet 8 electrostatically.

If the transfer sheet sensor 5 outputs a transfer sheet absence detect signal indicating that the transfer of the toner image is completed and the transfer sheet 8 is delivered from the secondary transfer portion, then, in accordance with this transfer sheet absence detect signal, the contact and separation control device 7 operates the contacting and separating mechanism 6 to thereby drive the secondary transfer roller 30 in a direction to depart from the intermediate transfer belt 28 just before the transfer sheet 8 leaves the contact point B. The structure and controlling method of the contacting and separating mechanism 6 may be similar to those of the contacting and separating mechanism that have been previously described with reference to FIGS. 2–6.

The cleaning roller 4 is disposed such that it can be contacted and rotated with the secondary transfer roller 30 at the retreat position of the secondary transfer roller 30 where the secondary transfer roller 30 is separated from the intermediate transfer belt 28. Accordingly, the contact rotation of the secondary transfer roller 30 and cleaning roller 4 can move foreign matters such as a toner, paper powder and the like stuck to the surface of the secondary transfer roller 30 to the cleaning roller 4 and the foreign matters can be then scraped off by a blade 4a provided in contact with the cleaning roller 4, so that the secondary transfer roller 30 can be cleaned.

In cleaning the secondary transfer roller 30, the contact and separation control device 7 gives a cleaning bias voltage output instruction to the bias voltage apply device 12, so that the bias voltage apply device 12 not only applies bias potentials consisting of a positive potential and a negative potential being applied alternately and repeatedly to the secondary transfer roller 30 for a period of at least one rotation of the secondary transfer roller 30 but also applies a zero bias potential or a grounding potential to the cleaning roller 4.

For example, there is carried out at least one time an operation in which the positive potential is applied to the secondary transfer roller 30 for the first rotation thereof, while the negative potential is applied for the next one rotation.

Here, as a simplified method, only the bias voltage of one polarity may be applied to the secondary transfer roller for a period of at least one rotation of the secondary transfer roller.

At the same time, the contact and separation controlling device 7 gives a speed control signal from the drive motor control device 11 to the secondary transfer roller 30 to thereby control the rotation speed of the secondary transfer roller 30 to be greater than the rotation speed thereof when the toner image is transferred secondarily.

Due to this structure, the whole periphery of the secondary roller 30 can be cleaned each time the transfer sheet detect sensor 5 detects the absence of the transfer sheet, and the secondary transfer roller 30 can be prevented from being contacted directly with the intermediate transfer belt 28 when no transfer sheet is detected. Also, even when the transfer sheets are different in size from one another and thus a toner adheres to the transfer sheets, since the secondary transfer roller 30 is always contacted with the transfer sheets in a clean condition, there is no possibility that the back surface of the transfer sheet can be contaminated.

The flow of the operation in the present embodiment is similar to that shown in FIGS. 8 and 9.

The secondary transfer roller 3 and cleaning roller 4 may also be structured such that they can be driven respectively by separate motors.

Now, FIG. 11 is an explanatory view of the timing of the cleaning of a manuscript image scanning system and a transfer roller in an image forming apparatus according to the invention, corresponding to the embodiment previously shown in FIG. 1.

Figure 11A:
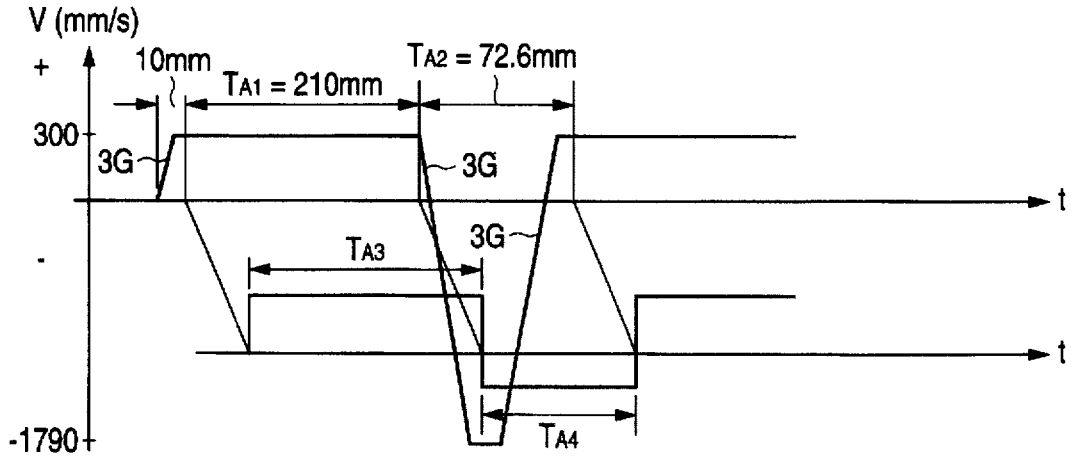
FIGS. 11A and 11B are explanatory views of a scanning system for scanning a manuscript image and a timing for cleaning the transfer roller in an image forming apparatus according to the invention.
Figure 11B:
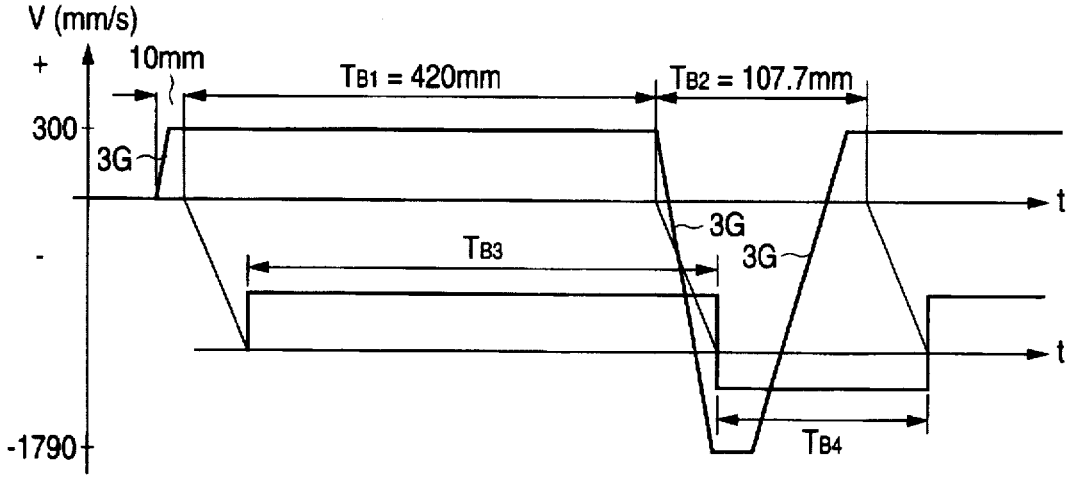
Figure 12:
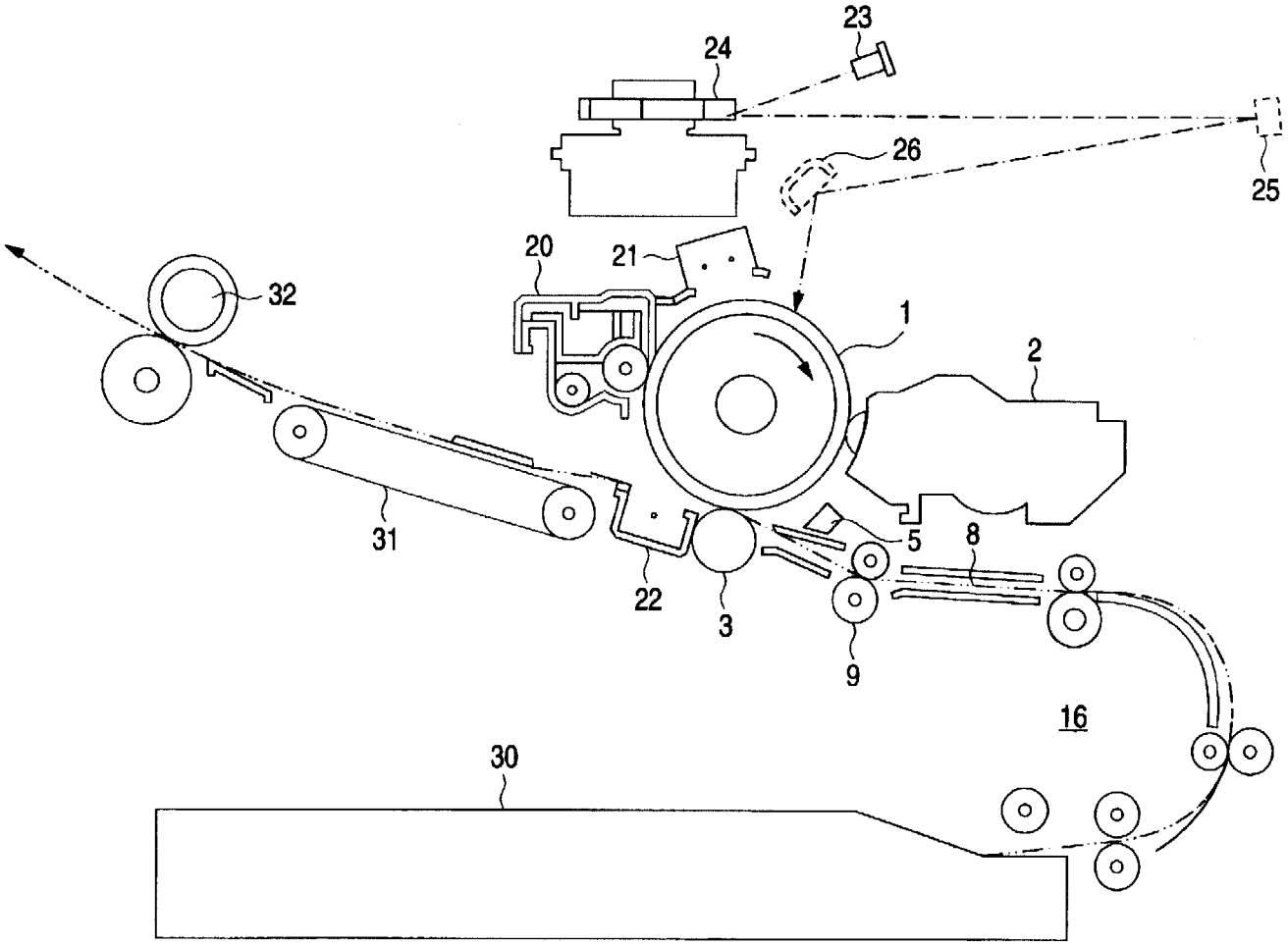
FIG. 12 is a schematic typical view of the structure of an example of an image forming apparatus to which the present invention is applied.
Figure 13:
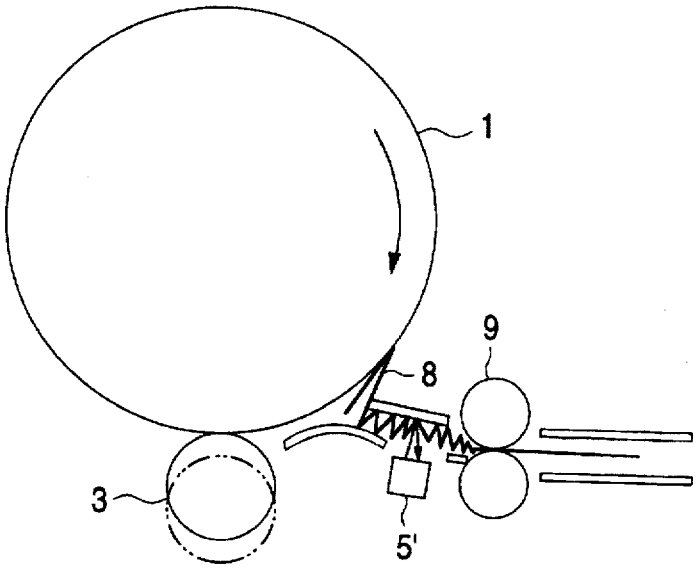
FIG. 13 PRIOR ART
FIG. 13 is a typical view to explain the contamination of the transfer roller when the transfer sheets jam in an image forming apparatus of a type that a transfer sheet detect sensor is disposed just behind a registration roller.
Figure 14:
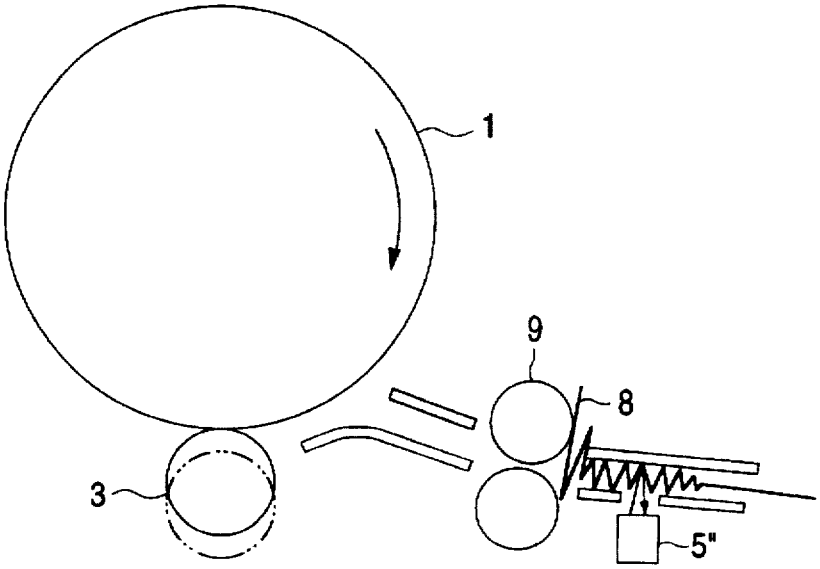
FIG. 14 PRIOR ART
FIG. 14 is a typical view to explain the contamination of the transfer roller when the transfer sheets jam in an image forming apparatus of a type that a transfer sheet detect sensor is disposed just before the registration roller.
Figure 15:
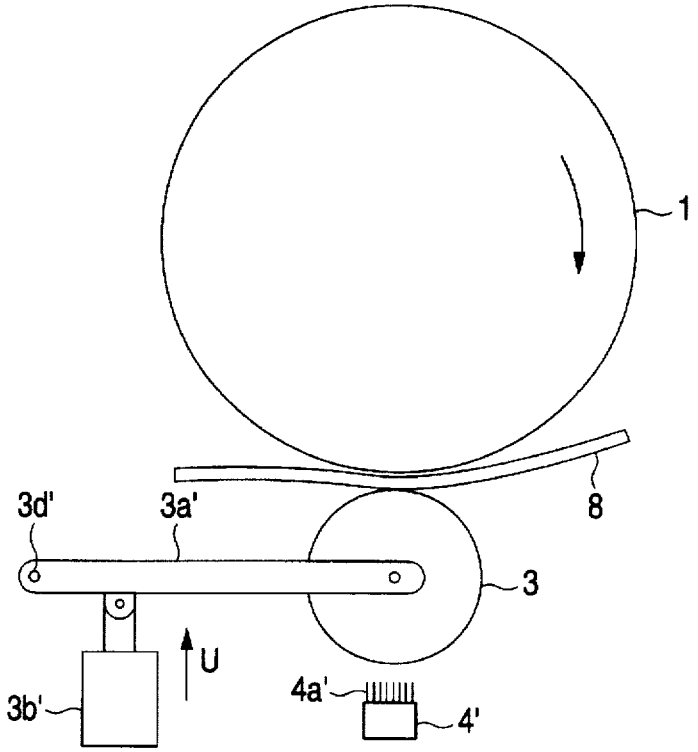
FIG. 15 PRIOR ART
FIG. 15 is a typical view to explain how to transfer a toner image to a transfer roller from a photoreceptor drum according to a conventional method in which the transfer roller is cleaned each time the transfer roller is separated from the photoreceptor drum.
Figure 16:
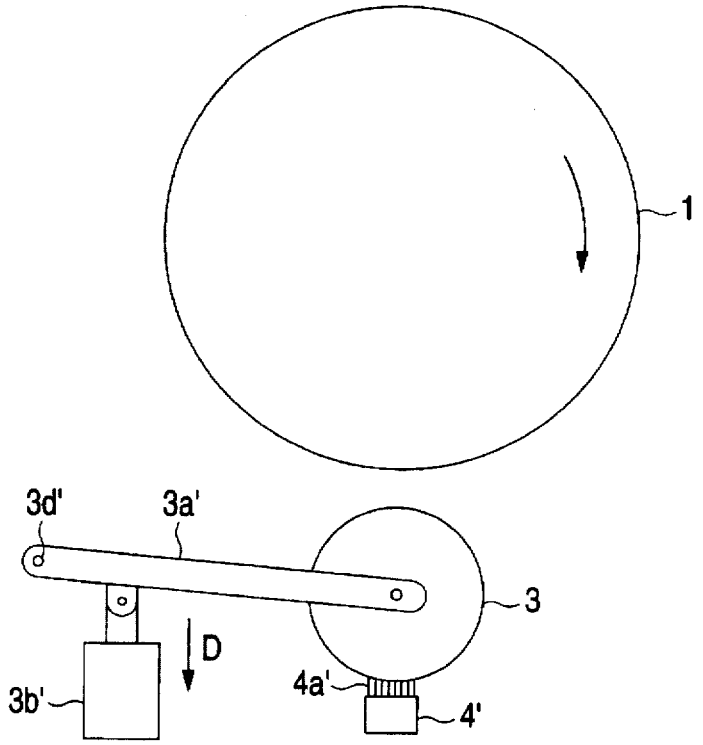
FIG. 16 PRIOR ART
FIG. 16 is a typical view to explain how to retreat the transfer roller according to the conventional method in which the transfer roller is cleaned each time the transfer roller is separated from the photoreceptor drum; and, FIG. 17 is a typical view of the main portions of the structure of an example of an image forming apparatus using a belt-shaped member as an intermediate transfer member.

In particular, FIG. 11A shows a case where a transfer sheet size is a horizontal A4 type, while FIG. 11B shows a case where a transfer sheet size is a vertical A3 type.

The rising of the manuscript scanning system is accelerated at 3 G (that is, +3 G) in the forward direction and is accelerated until the speed thereof reaches a process speed v=300 mm/s. When the speed of the manuscript scanning system reaches the speed v=300 mm/s, then the manuscript scanning system is made to move constantly at this speed to scan a manuscript image.

After the scanning system is shifted to the constant speed movement from the rising starting point, if the scanning by the scanning system is ended with the horizonal A4 transfer sheet width $T_{A1}$=210 mm from a time when 10 mm has elapsed, then, in order to scan back the scanning system, the scanning system is decelerated in the reverse direction at 3 G (that is, at −3 G in the forward direction) and is decelerated down to the scanning speed of 0 mm/s. If the speed of the scanning system reaches the speed of 0 mm/s, then the scanning system is accelerated further at −3 G and this acceleration is kept on until the speed of the scanning system arrives at the speed of −1790 mm/s.

If the scanning speed reaches the speed of −1790mm/s, then the scanning speed is decelerated at +3 G just before the scanning starting point to reach the speed of 0 mm/s at the scanning starting point. When carrying out the second and its following scannings, the same operations as above are repeated.

The feeding interval between the transfer sheets is determined by the deceleration of −3 G, acceleration of −3 G, speed of −1790 mm/s and deceleration of +3 G (when the fastest scanning operation is desired). This feeding interval provides a so called inter-image $T_{A2}$=72.6 mm.

As the photoreceptor drum is rotated, an electrostatic latent image is written into the photoreceptor drum in accordance with the information on the manuscript image scanned in the above-mentioned manner. The electrostatic latent image is then developed and delivered to the transfer position, where the developed image is transferred to the transfer sheet by the transfer roller during an image forming period of $T_{A3}$.

After completion of the image formation, the above-mentioned transfer roller is cleaned during a period of $T_{A4}$ which corresponds to the inter-image $T_{A2}$.

Also, for a vertical A3 transfer sheet, scanning is completed with the width of $T_{B1}$=420 mm, similarly to the above case, in order to scan back the scanning system, the scanning speed is decelerated at 3 G in the reverse direction (that is, at −3 G in the forward direction) down to the scan speed of 0 mm/s. When the scanning speed reaches the speed of 0 mm/s, then the scanning speed is accelerated further at −3 G and this acceleration is continued until the scanning speed reaches the speed of −1790 mm/s.

If the scanning speed reaches the speed of −1790 mm/s, then the scanning speed is decelerated at +3 G just before the scan starting point and it reaches the speed of 0 mm/s at the scan starting point. When carrying out the second and its following scans, the same operations as above are carried out repeatedly.

The feeding interval between the transfer sheets is determined by the deceleration of −3 G, acceleration of −3 G, speed of −1790 mm/s and deceleration of +3 G (when the fastest scan is desired). This feeding interval provides a so called inter-image $T_{B2}$=107.7 mm.

With the rotation of the photoreceptor drum, an electrostatic latent image is written into the photoreceptor drum in accordance with the information on the manuscript image scanned in the above-mentioned manner. The latent image is developed and is delivered to the transfer position, where the developed image is transferred to the transfer sheet by the transfer roller during an image forming period of $T_{B3}$.

After the image formation is completed, the above-mentioned transfer roller is cleaned during a period of $T_{B4}$ which corresponds to the inter-image $T_{B2}$.

In the present example, the above-mentioned inter-images $T_{A2}$ and $T_{B2}$, as described above, provide 72.6 mm for the horizontal A4 transfer sheet and 107.7 mm for the vertical A3 transfer sheet, respectively.

The above-mentioned example relates to an analog scanning method in which the manuscript read signal, as it is, is used in writing a latent image into the photoreceptor drum. On the other hand, in a digital scanning method in which a manuscript image read is stored once in a memory as digital data and the thus stored digital data is then output to drive a laser or the like to thereby form a latent image on the photoreceptor drum, it is not necessary to scan back the scanning system and, therefore, it is also possible to further reduce the sheet intervals (that is, inter-images) $T_{A2}$ and $T_{B2}$.

And, in cleaning the transfer roller, when the diameter of the transfer roller is assumed to be $L_0$=20 mm, then the length of the outer periphery of the transfer roller is 20 mm×π=62.8 mm. This shows that both of the inter-image $T_{A2}$=72.6 mm of the horizontal A4 transfer sheet and the inter-image $T_{B2}$=107.7 mm of the vertical A3 transfer sheet are less than the length of two rotations of the transfer roller. Therefore, by rotating the transfer roller at a twofold speed, there can be secured the length corresponding to the two rotations of the transfer roller and, at the same time, if positive and negative bias voltages are applied to the transfer roller, then the transfer roller can be cleaned.

Further, in the digital scanning method, when the sheet interval is reduced, such sheet interval reduction can be well coped with if the transfer roller is rotated faster by an amount corresponding to such reduction.

In an image forming apparatus using an intermediate transfer belt, after the elapse of a time necessary for a toner image formed on the intermediate transfer belt to reach a secondary transfer roller, secondary transfer is carried out and, similarly to the previously described case, the secondary transfer roller is cleaned during a period of the inter-image thereof.

In either of the above cases, for the horizontal A4 transfer sheet, the rotation speed of the transfer roller or secondary transfer roller when it is cleaned may be set 1.8 times the speed thereof when the toner image is transferred, because the peripheral length (62.8) thereof×2 (rotations)/$T_{A2}$ (72.6) =1.8.

On the other hand, for the vertical A3 transfer sheet, the rotation speed may be set 1.2 times the speed when the toner image is transferred, because the peripheral length (62.8) thereof×2 (rotations)/$T_{B2}$ (107.7)=1.2.

The present invention is not limited to the above-mentioned embodiments but it can also be applied in cleaning a rotary member of a roller type employed in other various apparatuses than the image forming apparatus using an intermediate transfer member.

As has been described heretofore, according to the invention, due to the fact that the transfer sheet detect sensor for detecting the presence or absence of the transfer sheet is disposed downstream of a tucking point at which the transfer sheet is tucked into the image carrier or intermediate transfer member and upstream of the contact point between the image carrier or intermediate transfer member and the transfer roller or secondary transfer roller, it is possible to prevent the sticking of the toner to the transfer roller or secondary transfer roller caused by the jamming of the transfer sheets advancing into the transfer portion, and it is also possible to prevent the transfer roller and secondary transfer roller from being contaminated by the toner when a transfer sheet of a small size is passed thereon to thereby increase the life of the transfer roller or secondary transfer roller. That is, according to the invention, it is possible to provide an image forming apparatus which can form an image of a high quality at a high speed.

What is claimed is:

1. An image forming apparatus, comprising:

an image carrier for forming thereon an electrostatic latent image corresponding to image information;

a developing device for developing said electrostatic latent image formed on the surface of said image carrier to thereby form a toner image;

a transfer member contactable with said image carrier through a transfer sheet being fed for transferring said toner image carried on said image carrier to said transfer sheet;

a registration roller for deciding the supply timing of said transfer sheet to be supplied into between said image carrier and said transfer member and also for feeding said transfer sheet to a tucking point provided on the surface of said image carrier;

a transfer sheet detect sensor disposed downstream of said tucking point in the feeding direction of said transfer sheet and upstream of a point of contact at which said image carrier and said transfer member are contacted with each other; and, a contacting and separating means, when said transfer sheet is detected by said transfer sheet detect sensor, for bringing said transfer member into contact with said image carrier.

2. An image forming apparatus, comprising:

an image carrier for forming thereon an electrostatic latent image corresponding to image information;

a developing device for developing said electrostatic latent image formed on the surface of said image carrier to thereby form a toner image;

a transfer roller contactable with said image carrier through a transfer sheet being fed for transferring said toner image carried on said image carrier to said transfer sheet;

contacting and separating means for contacting said transfer roller with said image carrier and separating said transfer roller from said image carrier in accordance with a signal from a transfer sheet detect sensor;

a cleaning member contactable with said transfer roller at a position where said transfer roller is separated from said image carrier by said contacting and separating means; and, transfer roller rotation speed control means for increasing the rotation speed of said transfer roller when said transfer roller is in contact with said cleaning member at the position thereof separated from said image carrier over the rotation speed of said transfer roller when said transfer roller is in contact with said image carrier.

3. The image forming apparatus of claim 2, further comprising:

a contact and separation control means for controlling said contacting and separating means in such a manner that said contacting and separating means allows said transfer roller to be contacted with said image carrier at a time when the leading end of said transfer sheet in the feeding direction thereof reaches a transfer position at which said transfer roller is disposed and also allows said transfer roller to be separated from said image carrier at a time when the trailing end of said transfer sheet in the feeding direction thereof departs from said transfer position.

4. The image forming apparatus of claim 2, wherein said transfer roller rotation speed control means varies said transfer roller rotation speed when said transfer roller is contacted with said cleaning member at the position thereof separated from said image carrier in accordance with intervals between transfer sheets being supplied successively into between said image carrier and said transfer roller.

5. The image forming apparatus of claim 2, further comprising:

bias voltage apply means, when said transfer roller is contacted with said cleaning member at the position thereof separated from said image carrier, for applying two kinds of bias voltages, one voltage having the opposite polarity to the polarity of said toner image carried on said image carrier and the other having the same polarity as said toner image polarity, to said transfer roller for a period of one rotation or more of said transfer roller.

6. An image forming apparatus, comprising:

an image carrier for forming thereon an electrostatic latent image corresponding to image information;

a developing device for developing said electrostatic latent image formed on the surface of said image carrier to thereby form a toner image; and, an intermediate transfer member for transferring primarily said toner image formed on the surface of said image carrier, the primary transfer being repeatedly performed on said intermediate transfer member for each of a plurality of colors to thereby superimpose toner images of a plurality of colors on top of each other on said intermediate transfer member and, after then, said color toner images of a plurality of colors being transferred secondarily to a transfer sheet as a whole;

a secondary transfer roller contactable with said intermediate transfer member through said transfer sheet for transferring secondarily said color toner image carried on said intermediate transfer member to said transfer sheet;

a registration roller for deciding the supply timing of said transfer sheet being supplied into between said intermediate transfer member and said secondary transfer roller and also for feeding said transfer sheet to a tucking point provided on the surface of said intermediate transfer member;

a transfer sheet detect sensor disposed downstream of said tucking point in the feeding direction of said transfer sheet and upstream of a point of contact at which said intermediate transfer member and said secondary transfer roller are contacted with each other; and, a contacting and separating means, when said transfer sheet is detected by said transfer sheet detect sensor, for bringing said secondary transfer roller into contact with said intermediate transfer member.

7. An image forming apparatus, comprising:

an image carrier for forming thereon an electrostatic latent image corresponding to image information;

a developing device for developing said electrostatic latent image formed on the surface of said image carrier to thereby form a toner image;

an intermediate transfer member for transferring primarily said toner image formed on the surface of said image carrier, the primary transfer being repeatedly performed on said intermediate transfer member for each of a plurality of colors to thereby superimpose toner images of a plurality of colors on top of each other on said intermediate transfer member and, after then, said color toner images of a plurality of colors being transferred secondarily to a transfer sheet as a whole;

a secondary transfer roller contactable with said intermediate transfer member through said transfer sheet for transferring secondarily said color toner image carried on said intermediate transfer member to said transfer sheet;

contacting and separating means for contacting and separating said secondary transfer roller with respect to said intermediate transfer member in accordance with a signal from a transfer sheet detect sensor;

a cleaning member contactable with said secondary transfer roller at a position thereof where said secondary transfer roller is separated from said intermediate transfer member by said contacting and separating means; and secondary transfer roller rotation speed control means for increasing the rotation speed of said secondary transfer roller when said secondary transfer roller is in contact with said cleaning member at the position thereof separated from said intermediate transfer member over the rotation speed of said secondary transfer roller when said secondary transfer roller is in contact with said intermediate transfer member.

8. The image forming apparatus of claim 7, further comprising:

a contact and separation control device for controlling said contacting and separating means in such a manner that said contacting and separating means allows said secondary transfer roller to be contacted with said intermediate transfer member at a time when the leading end of said transfer sheet in the feeding direction thereof reaches a secondary transfer position provided with said secondary transfer roller and also allows said secondary transfer roller to be separated from said intermediate transfer member at a time when the trailing end of said transfer sheet in the feeding direction thereof departs from said secondary transfer position.

9. The image forming apparatus of claim 7, further comprising:

a bias voltage apply device, when said secondary transfer roller is contacted with said cleaning member at the position thereof separated from said intermediate transfer member, for applying two kinds of bias voltages, one voltage having the opposite polarity to the polarity of said toner image carried on said intermediate transfer member and the other having the same polarity as said toner image polarity, to said secondary transfer roller respectively for a period of one rotation or more of said secondary transfer roller.

* * * * *